US007918112B2

(12) United States Patent
Fawcett et al.

(10) Patent No.: US 7,918,112 B2
(45) **Date of Patent: *Apr. 5, 2011**

(54) CABLE WRAP SECURITY DEVICE

(75) Inventors: Christopher J. Fawcett, Charlotte, NC (US); Ronald M. Marsilio, Lake Wiley, SC (US)

(73) Assignee: Checkpoint Systems, Inc., Philadelphia, PA (US)

( * ) Notice: Subject to any disclaimer, the term of this patent is extended or adjusted under 35 U.S.C. 154(b) by 19 days.

This patent is subject to a terminal disclaimer.

(21) Appl. No.: 12/396,164

(22) Filed: Mar. 2, 2009

(65) Prior Publication Data

US 2009/0158786 A1 Jun. 25, 2009

Related U.S. Application Data

(63) Continuation of application No. 11/647,014, filed on Dec. 28, 2006, now Pat. No. 7,497,101, which is a continuation of application No. 11/318,668, filed on Dec. 27, 2005, now Pat. No. 7,168,275, which is a continuation-in-part of application No. 11/023,721, filed on Dec. 28, 2004, now Pat. No. 7,162,899.

(51) Int. Cl.
*E05B 65/00* (2006.01)
*E05B 45/00* (2006.01)

(52) U.S. Cl. ..... 70/57; 70/49; 70/57.1; 242/382

(58) Field of Classification Search ..... 70/14, 18, 70/19, 30, 49, 57, 57.1, 58, 233; 242/382, 242/382.5, 384.7, 388, 396.2, 396.4
See application file for complete search history.

(56) References Cited

U.S. PATENT DOCUMENTS

| | | | |
|---|---|---|---|
| 199,468 | A | 1/1878 | Rheubottom |
| 343,849 | A | 6/1886 | Pond |
| 394,739 | A | 12/1888 | Toulmin |
| 437,548 | A | 9/1890 | Anderson |
| 596,237 | A | 12/1897 | Damon |
| 639,196 | A | 12/1899 | Fehling |
| 673,612 | A | 5/1901 | Appleby |
| 886,905 | A | 5/1908 | Ward |
| 895,403 | A | 8/1908 | Jackson |
| 1,083,612 | A | 1/1914 | Hooker |
| 1,124,130 | A | 1/1915 | Grant |

(Continued)

FOREIGN PATENT DOCUMENTS

| | | |
|---|---|---|
| DE | 27 25 580 | 12/1977 |

(Continued)

*Primary Examiner* — Suzanne D Barrett
*Assistant Examiner* — Christopher Boswell
(74) *Attorney, Agent, or Firm* — Sand & Sebolt

(57) ABSTRACT

A security device a plurality of cables which are securable about an item of merchandise with a locking member and a cable-tightening mechanism each connected to the cables in a spaced apart manner. The locking member includes a key portion for unlocking the tightening mechanism when the cable is removed from the item. The tightening mechanism includes a spool and a ratchet mechanism. Alternate embodiments for locking and unlocking the ratchet mechanism are disclosed. The tightening mechanism carries sense loops which if compromised actuate an onboard audible alarm. The cables are part of one or more of the sense loops. The device is configured to sound a security gate alarm upon passing through the gate and upon simply reaching a certain distance from the gate. The tightening mechanism includes a housing having a flip-up handle for tightening the ratchet mechanism to tighten the cable.

34 Claims, 29 Drawing Sheets

U.S. PATENT DOCUMENTS

| | | | | |
|---|---|---|---|---|
| 1,141,245 | A | 6/1915 | Gillespie | |
| 1,165,320 | A | 12/1915 | Clary | |
| 1,165,816 | A | 12/1915 | Tichenor | |
| 1,657,190 | A | 1/1928 | Ballou | |
| 1,992,868 | A | 2/1935 | Krause | |
| 2,002,946 | A | 5/1935 | Jacobs | |
| 3,395,555 | A | 8/1968 | Hickman | |
| 3,397,849 | A | 8/1968 | Hansen | |
| 3,466,668 | A | 9/1969 | Ochial | |
| 3,568,902 | A | 3/1971 | Highberger | |
| 3,611,760 | A | 10/1971 | Muther | |
| 3,831,407 | A | 8/1974 | Coleman | |
| 3,906,758 | A | 9/1975 | Hurwitt | |
| 3,929,300 | A | 12/1975 | Lindqvist | |
| 4,004,440 | A | 1/1977 | Dreyer | |
| 4,071,023 | A | 1/1978 | Gregory | |
| 4,086,795 | A | 5/1978 | Foster et al. | |
| 4,136,843 | A | 1/1979 | Gourley | |
| 4,418,551 | A | 12/1983 | Kochackis | |
| 4,756,171 | A | 7/1988 | Homar | |
| 4,823,465 | A | 4/1989 | Collins | |
| 4,896,517 | A | 1/1990 | Ling | |
| 4,930,324 | A | 6/1990 | Meier | |
| 4,949,679 | A | 8/1990 | Wolfer | |
| 5,144,821 | A | 9/1992 | Ernesti et al. | |
| 5,156,028 | A | 10/1992 | Jiang | |
| 5,178,619 | A | 1/1993 | Galazaka | |
| 5,193,368 | A | 3/1993 | Ling | |
| 5,345,947 | A | 9/1994 | Fisher | |
| 5,379,496 | A | 1/1995 | Krauss | |
| 5,517,836 | A | 5/1996 | Hong | |
| 5,551,447 | A | 9/1996 | Hoffman et al. | |
| 5,581,853 | A | 12/1996 | Miller et al. | |
| 5,598,727 | A | 2/1997 | White | |
| 5,610,587 | A | 3/1997 | Fujiuchi et al. | |
| 5,671,506 | A | 9/1997 | Eliasson | |
| 5,687,455 | A | 11/1997 | Alexander | |
| 5,687,456 | A | 11/1997 | Chang | |
| 5,722,266 | A | 3/1998 | Yeager et al. | |
| 5,794,464 | A | 8/1998 | Yeager et al. | |
| 5,856,782 | A | 1/1999 | Sasagawa et al. | |
| 5,960,652 | A | 10/1999 | Marmstad | |
| 6,092,401 | A | 7/2000 | Sankey et al. | |
| 6,128,932 | A | 10/2000 | Mainetti et al. | |
| 6,237,375 | B1 | 5/2001 | Wymer | |
| 6,550,293 | B1 | 4/2003 | Delegato et al. | |
| 6,755,055 | B2 | 6/2004 | Sedon et al. | |
| 7,162,899 | B2 * | 1/2007 | Fawcett et al. | 70/57 |
| 7,168,275 | B2 * | 1/2007 | Fawcett et al. | 70/57 |
| 7,497,101 | B2 * | 3/2009 | Fawcett et al. | 70/57 |
| 2003/0182763 | A1 | 10/2003 | Jeffries | |
| 2008/0034815 | A1 | 2/2008 | Fawcett | |

FOREIGN PATENT DOCUMENTS

| | | |
|---|---|---|
| EP | 0 620 381 AI | 10/1994 |
| SE | 123470 | 11/1948 |
| WO | WO 2006 040693 A2 | 4/2006 |

* cited by examiner

CABLE WRAP SECURITY DEVICE

CROSS REFERENCE TO RELATED APPLICATIONS

This application is a continuation of U.S. patent application Ser. No. 11/647,014, filed Dec. 28, 2006 now U.S. Pat. No. 7,497,101; which is a continuation of U.S. patent application Ser. No. 11/318,668, filed Dec. 27, 2005, now U.S. Pat. No. 7,168,275, which is a continuation-in-part of U.S. patent application Ser. No. 11/023,721, filed Dec. 28, 2004, now U.S. Pat. No. 7,162,899; the disclosures of which are incorporated herein by reference.

BACKGROUND OF THE INVENTION

1. Technical Field

The invention relates to a security device, and more particularly to an adjustable security device which wraps around and secures a box-like structure in a secure locked position. Even more particularly, the invention relates to such a cable security device which includes a plurality of wires or cable that wrap around the article to be protected and has an unique ratchet mechanism for tightening the cable around the article of merchandise and a quick release locking mechanism, and which has an attached key for unlatching the ratchet mechanism.

2. Background Information

Retail stores have a difficult time protecting boxes containing various expensive merchandise, books and other similarly structured packages, or protecting such containers from being opened and the contents thereof being removed without authorization from store personnel or damaged while on display. Consumers often want to visually inspect the packaged expensive articles before deciding to purchase them. The store is faced with the problem of how to protect these expensive articles from theft while displaying them for sale.

One method used to protect these packages and the articles contained therein is to enclose the article within a transparent glass display case which can only be accessed from behind a counter of the retail store. The consumer can view the article through the glass but is not able to handle the article or read any of the information about the article that may be printed on the box unless a store clerk removes the article from the case. However, in large retail stores, the problem then arises of getting the selected merchandise to the customer after the customer wishes to purchase the same without subjecting the merchandise to theft. One manner is to maintain a supply of the boxes containing the expensive articles or merchandise close at hand for delivery to or pick-up by the customer for subsequent taking to a check-out clerk. However this makes the boxes susceptible to theft and requires additional sales personnel.

Another method used by retail stores is to list the article in a catalog and require consumers to place an order from the catalog. The article is delivered from a back storage area and the consumer must simultaneously pick up and pay for the merchandise at the same location to prevent unauthorized removal from the store. The consumer does not get to inspect the article before purchasing and if they are not satisfied they must undergo the hassle of returning the article for a refund.

Boxes and box-like structures are also subjected to unauthorized openings while being shipped via a courier. These articles can be easily opened and resealed when packaged and taped-shut in the conventional manner without the recipient or the sender knowing of such actions. Shipped packages can be secured within a security container with a locking mechanism but these containers are expensive to purchase and add size and weight to the package making it more expensive to ship. Also, would-be thieves can gain unauthorized access to the contents of these containers by "picking" the locking mechanisms or possibly guessing the combination to a combination lock.

Few prior art locking devices have adequately solved this problem of securing packages or objects in a closed condition while being displayed in retail stores or shipped from one location to another. Some prior art security devices include a wire which wraps around an article and is secured by some type of locking mechanism. For example, see U.S. Pat. Nos. 3,611,760, 4,418,551, 4,756,171, 4,896,517, 4,930,324, 5,156,028, 5,794,464, and 6,092,401.

The particular security device shown in U.S. Pat. No. 5,794,464 has proven satisfactory, but requires a special tool to operate the latch mechanism, both for tightening the cable about the object to be protected and to release the latch mechanism after the security device has been removed from the package to enable the internal mechanism on which the cable is wound to be free-wheeling in order to be pulled outwardly to a larger size for placement around another package. This separate and specially designed key becomes a problem in that it can become lost or stolen and must always be associated with and manipulated for operating the security device.

Furthermore, the ratchet mechanism of U.S. Pat. No. 5,794,464 as well as the other known cable wrap ratchet-actuated security devices can be defeated by excessive force or manipulation of the ratchet device and/or of the package being protected, which could go undetected by the store personnel.

Therefore, the need exists for a cable wrap security device which includes a ratchet member and a locking member which does not require any special tool to tighten the cable about a package, in which part of the lock mechanism forms the tool for unlatching the ratchet mechanism to provide for the free-wheeling of the internal spool thereof, and in which the ratchet member can be provided with an internal audible alarm which will be actuated if the integrity of the security device is compromised or the protected article stolen from the retail store.

BRIEF SUMMARY OF THE INVENTION

The security device of the present invention includes a plurality of wires or cables which encircle and lock all six sides of a box, package, book or other similar structure. The cable extends between a ratchet member which includes a gear with a plurality of teeth, a one-way pawl which engages the teeth, and a locking member which includes a fastener which snap-fits to a base and requires a special unlocking tool or key to unlock.

Another feature of the present invention is to provide such a security device which requires only a special magnetic key to unlock the locking member to enable the cable to be removed from the protected device.

A further feature of the present invention is to provide the device with an audible alarm which is actuated should the integrity of a sensing loop in the securing cable be jeopardized or compromised, and in which the security device contains an EAS tag which actuates an alarm at a security gate should a potential thief attempt to leave the premise before removing the cable wrap security device from the protected article.

A still further feature of the invention is to provide such a security device which includes a one-way ratchet which can be released by a key formation formed on the locking mechanism thereby eliminating the need for a separate key to release the latching mechanism as heretofore required.

Another feature of the invention is to provide such a security device in which the locking mechanism is open by a specially designed magnetic release mechanism.

Still another aspect of the invention is to provide such a security device in which the ratchet mechanism is actuated to tighten the cable about an article by a flip-up handle on the ratchet mechanism avoiding the need for a special key to rotate the ratchet mechanism and tighten the cable about the protected article.

These features are obtained by the security device of the present invention, the general nature of which may be stated as comprising a cable for placement about an object to be secured; a ratchet mechanism connected to the cable having a flip-up handle moveable between a raised operating position for manual rotation for tightening the cable around the object and a down position conforming generally to the contour of the ratchet mechanism; and a two-piece locking member including a base and a fastener which are connected to the cable and releasably locked together for releasably locking said cable about the object.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
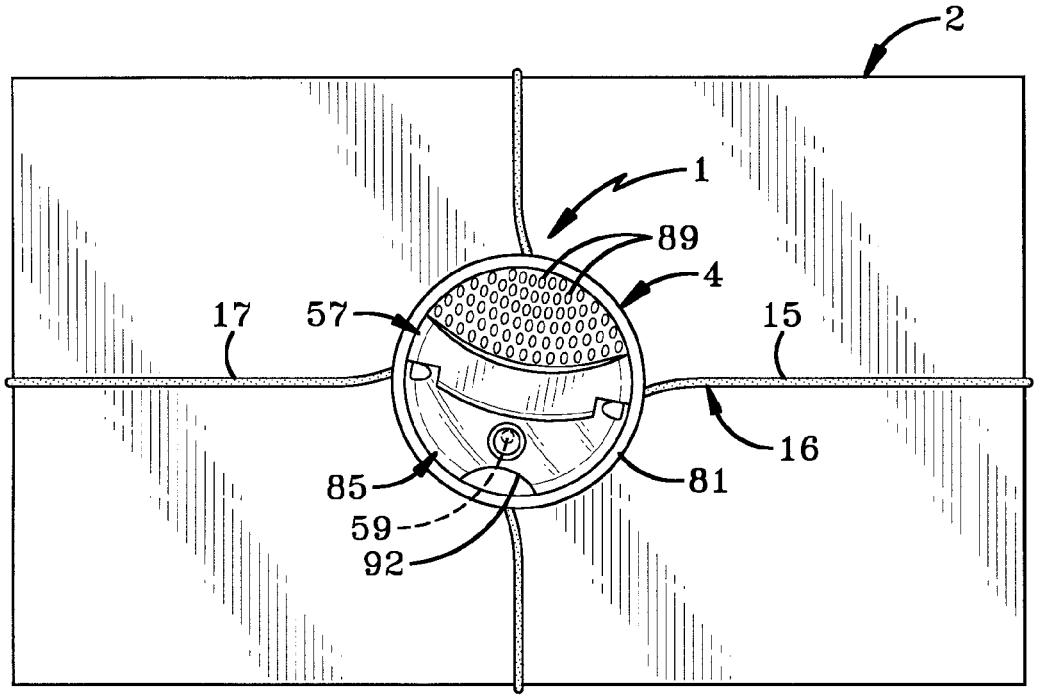
FIG. 1 is a diagrammatic plan view showing the security device of the present invention secured on a package.
Figure 2:
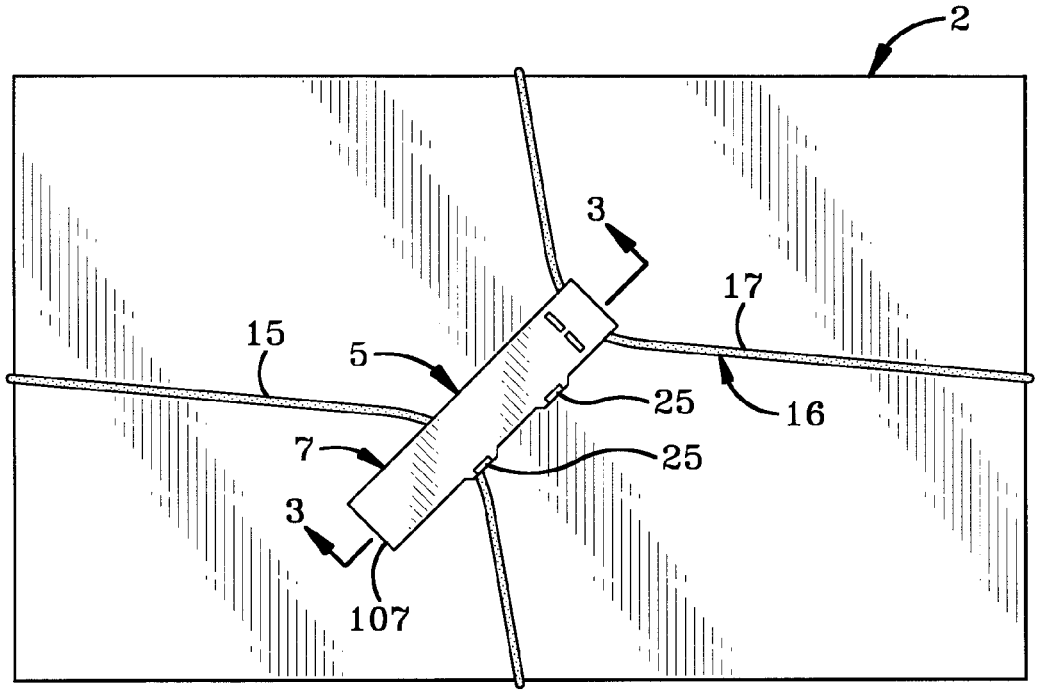
FIG. 2 is a view similar to FIG. 1 showing the locking member of the security device located on the opposite side of the package from that of the ratchet mechanism shown in FIG. 1.

The security device of the present invention is indicated generally at 1, and is shown in FIGS. 1 and 2 secured about a package 2. Security device 1 includes two main components, a ratchet mechanism and a locking member indicated generally at 4 and 5, respectively.

Figure 3:
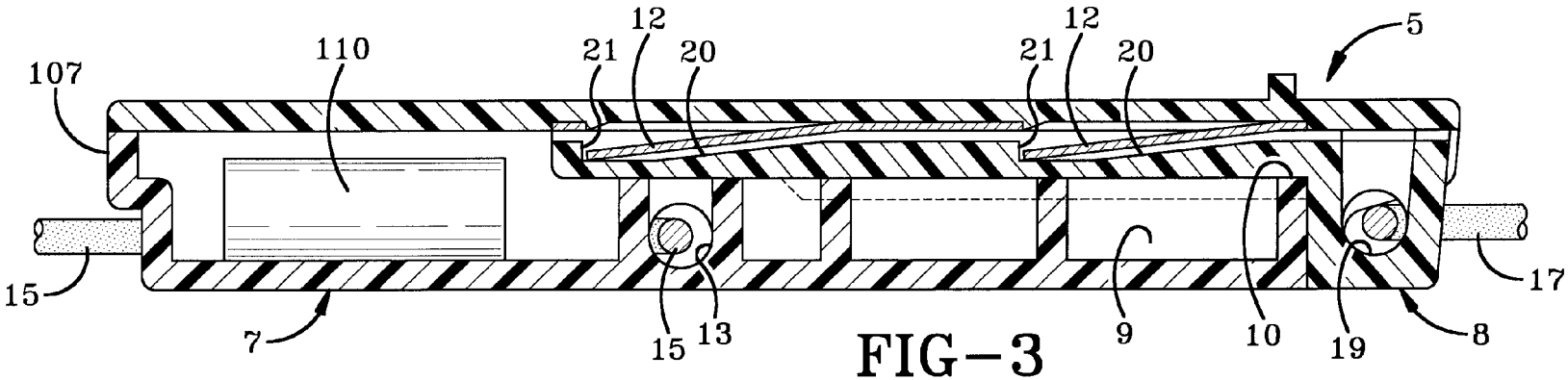
FIG. 3 is an enlarged sectional view taken on line 3-3, FIG. 2 showing the locking member in a locked position.
Figure 4:
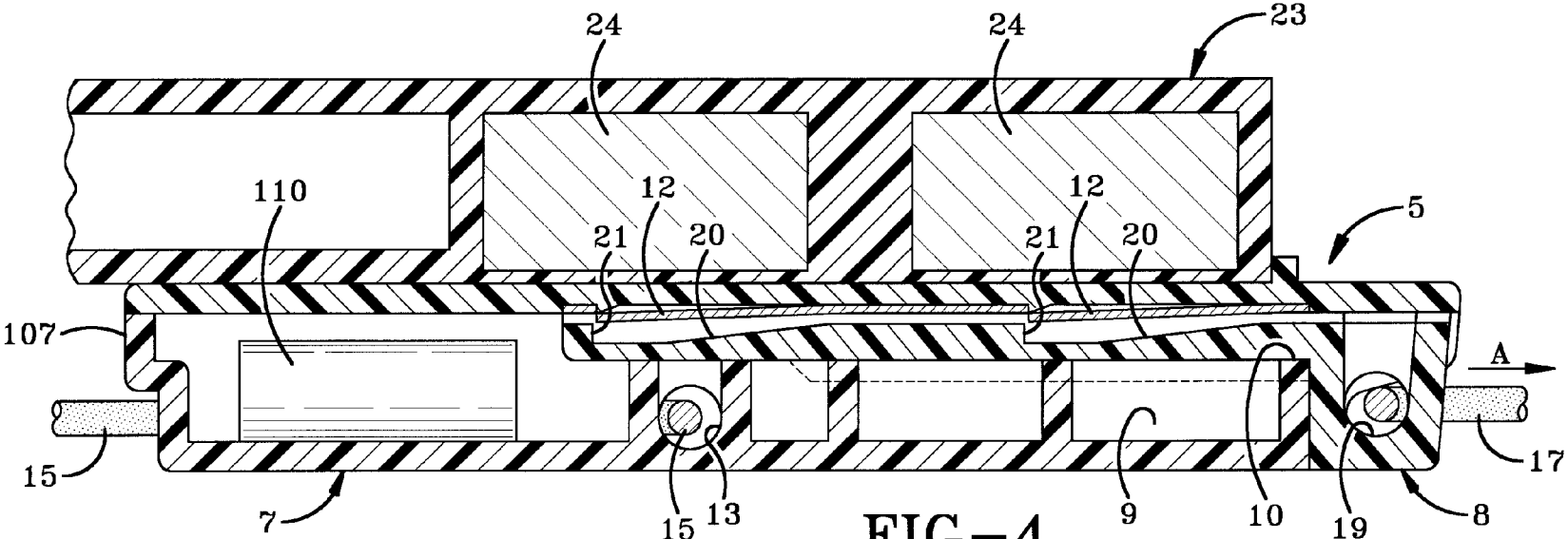
FIG. 4 is a view similar to FIG. 3 showing a magnetic key unlocking the locking member.
Figure 5:
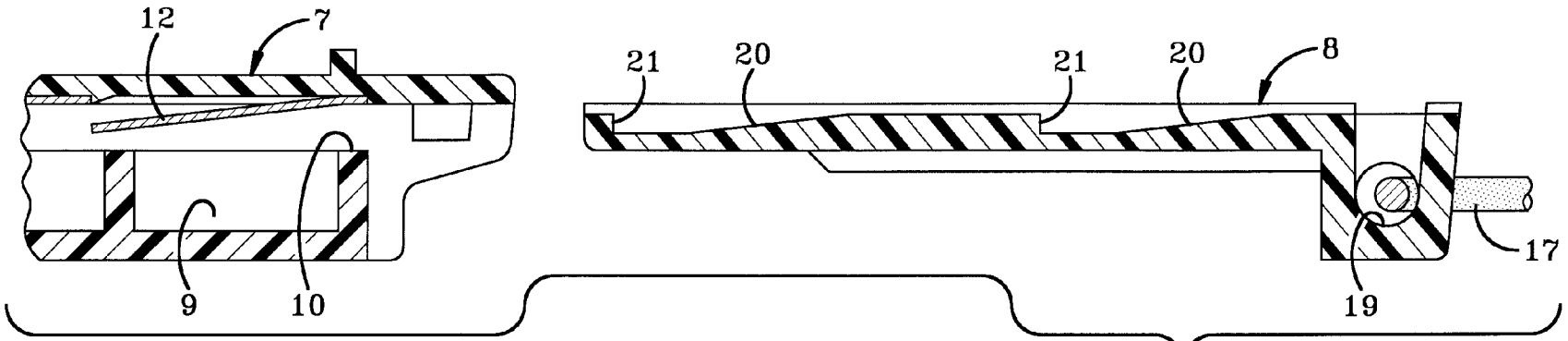
FIG. 5 is a sectional view showing the two-piece locking member in a disengaged unlocked position.

Locking member 5 shown particularly in FIGS. 3-5, is a two-piece member consisting of a base 7 and a fastener 8. Base 7 preferably is an elongated member formed of rigid plastic having an internal chamber 9 and an entrance opening 10. A pair of metal tines 12 are mounted within chamber 9 and are biased inwardly as shown particularly in FIG. 3. Base 7 is formed with a through opening 13 through which extends a first cable loop 15, which is one portion of the securing cable collectively indicated at 16.

Fastener 8 is an elongated member preferably formed of rigid plastic, and has another cable loop 17 extending through an opening 19 formed in one end of the fastener. Fastener 8 is formed with a pair of angled recesses 20 which terminate in shoulders 21 which are engaged by the distal ends of metal tines 12 when fastener 8 is inserted into base 7 as shown in FIG. 3, to secure fastener 8 in a locked position within base 7. Fastener 8 cannot be withdrawn toward the unlocking position as shown in FIG. 5, due to the engagement of the distal ends of metal tines 12 with shoulders 21. However, locking member 5 is opened easily by a clerk at the checkout counter of a retail store by placement of a magnetic key 23 in a controlled position on base 7. Key 23 contains a pair of magnets 24 and are positioned to align with a respective metal tine 12 to move the metal tines out of locking engagement with its respective shoulder 21. This enables fastener 8 to be moved in the direction of Arrow A (FIG. 4) to disengage from base 7 as shown in FIG. 5.

Locking member 5 preferably includes a pair of alignment projections 25 (FIG. 2) which align with projections on key 23 to ensure that magnetic key 23 is properly placed on member 5 so that magnets 24 accurately align with their respective metal tines 12 to move the tines to the unlocked position. This specially positioned pair of magnets 24 in relationship to the spaced tines 12, reduces the possibility of a shoplifter unlocking locking member 5 by use of a single unauthorized magnet.

Ratchet mechanism 4 (FIGS. 7-13) includes a housing 27 which has a cylindrical side wall 28 and a stepped bottom wall 29. Bottom wall 29 (FIG. 9) has a first raised cylindrical surface 30 and a lower concentric cylindrical surface 31, with a plurality of one-way gear teeth 32 being formed on a connecting surface extending between surfaces 30 and 31 and extending circumferentially thereabout. Four openings 34 are formed in side wall 28 and upper cylindrical surface 30 for the passage of securing cable 16 therethrough as discussed further below. A large circular central opening 36 is formed in bottom wall 29 for receiving a pawl release plate 37 therein. Housing 27 preferably is a one-piece member formed of a rugged plastic material.

Ratchet mechanism 4 further includes a spool indicated generally at 40 (FIGS. 12 and 13), which includes a central hub 41 and first and second spaced flanges 42 and 43 extending outwardly therefrom and spaced from each other for capturing cable 16 therebetween when the cable loops 15 and 17 are tightened about package 2. Spool 40 preferably is a one-piece member molded of a rigid plastic material and cable 16 preferably is comprised of the two cable sections or loops 15 and 17. A circular central recess 45 (FIG. 9) is formed in flange 43 and contains a printed circuit board 46 which includes the necessary electronic circuitry (not shown) well-known in the art, for providing an alarm system discussed further below. Four slotted holes 48 are formed in flange 43 and communicate with cable openings 34 for inserting enlarged ends 49 of cable loops 15 and 17 therethrough. Ends 49 are metallic and are received within small compartments 51 formed on circuit board 46, where they are connected to the electric circuitry of circuit board 46 by conductors 52. Three of the four cable enlarged ends 49 are shown seated within their respective compartments 51 and are connected to circuit board 46 by conductors 52.

The alarm system further includes an audible alarm having a speaker 54 (FIG. 9) which is mounted within a complimentary shaped circular recess 55 formed on the inside surface of a top wall portion 57, which is another of the main components of ratchet mechanism 4. Speaker 54 is connected to circuit board 46 by a pair of conductors 58. The alarm system further includes a LED 59 which aligns with a hole 60 formed in top wall portion 57. LED 59 is connected in the alarm circuitry and preferably provides a blinking action which indicates that the alarm system is operating serving as a deterrent to a possible shoplifter.

Figure 14:
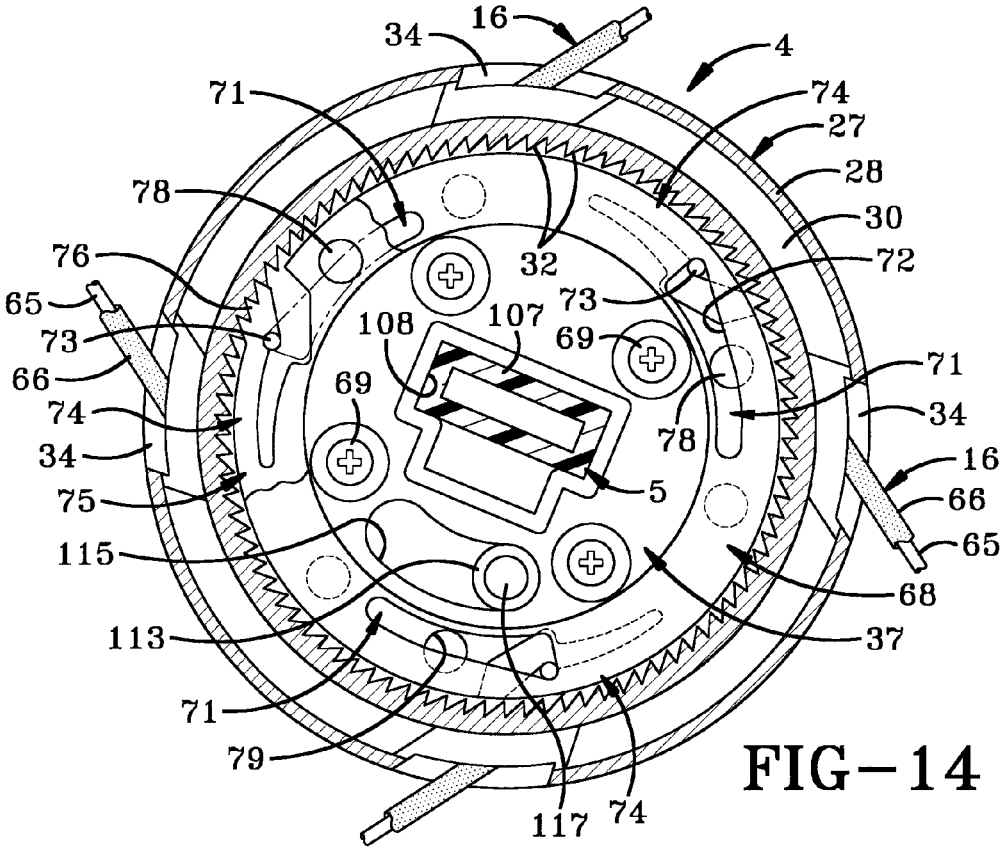
FIG. 14 is a bottom plan view of the ratchet mechanism with portions broken away and in section, showing the end of the locking member base engaged with the pawl release bottom plate of the ratchet mechanism.
Figure 15:
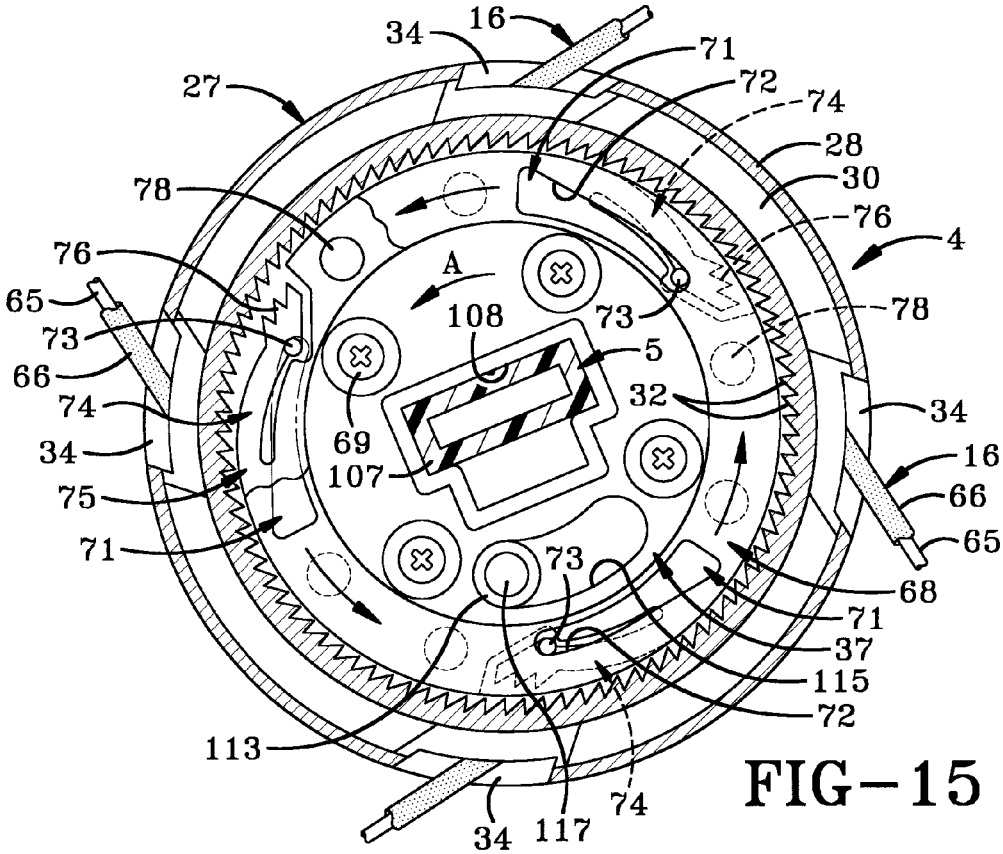
FIG. 15 is a view similar to FIG. 14 showing the bottom plate of the ratchet mechanism moving the locking pawls of the gear disc out of engagement with the gear teeth of the gear housing to place the cable spool in a free wheeling position.

In further accordance with the invention, the alarm system includes a sense loop which extends through the cable loops 15 and 17 by the electrical connection of enlarged ends 49 with circuit board 46 through conductors 52. The alarm system sends a series of pulses or maintains a constant flow of electrical energy through the cables by power supplied by a battery 62 (FIG. 12) which is located within a complimentary shaped recess 63 formed within the central opening of flange 42. Battery 62 is connected to the circuitry of circuit board 46 by a metallic connector 64. Thus, the alarm system contained within ratchet mechanism 4, provides a continuous sensing loop extending through the cables, which as shown in FIGS. 14 and 15, will include an inner metallic conductor 65 covered by a layer of insulation 66. Cable loops 15 and 17 provide the necessary mechanical strength for securing security device 1 about package 2, as well as the electrical circuitry to provide a sensing loop, which if compromised in any manner, such as cutting through one of the cable conductors 65 or pulling it loose from its connection to the printed circuit board, will actuate the audible alarm alerting store personnel of the unauthorized tampering of security device 1.

Figure 12:
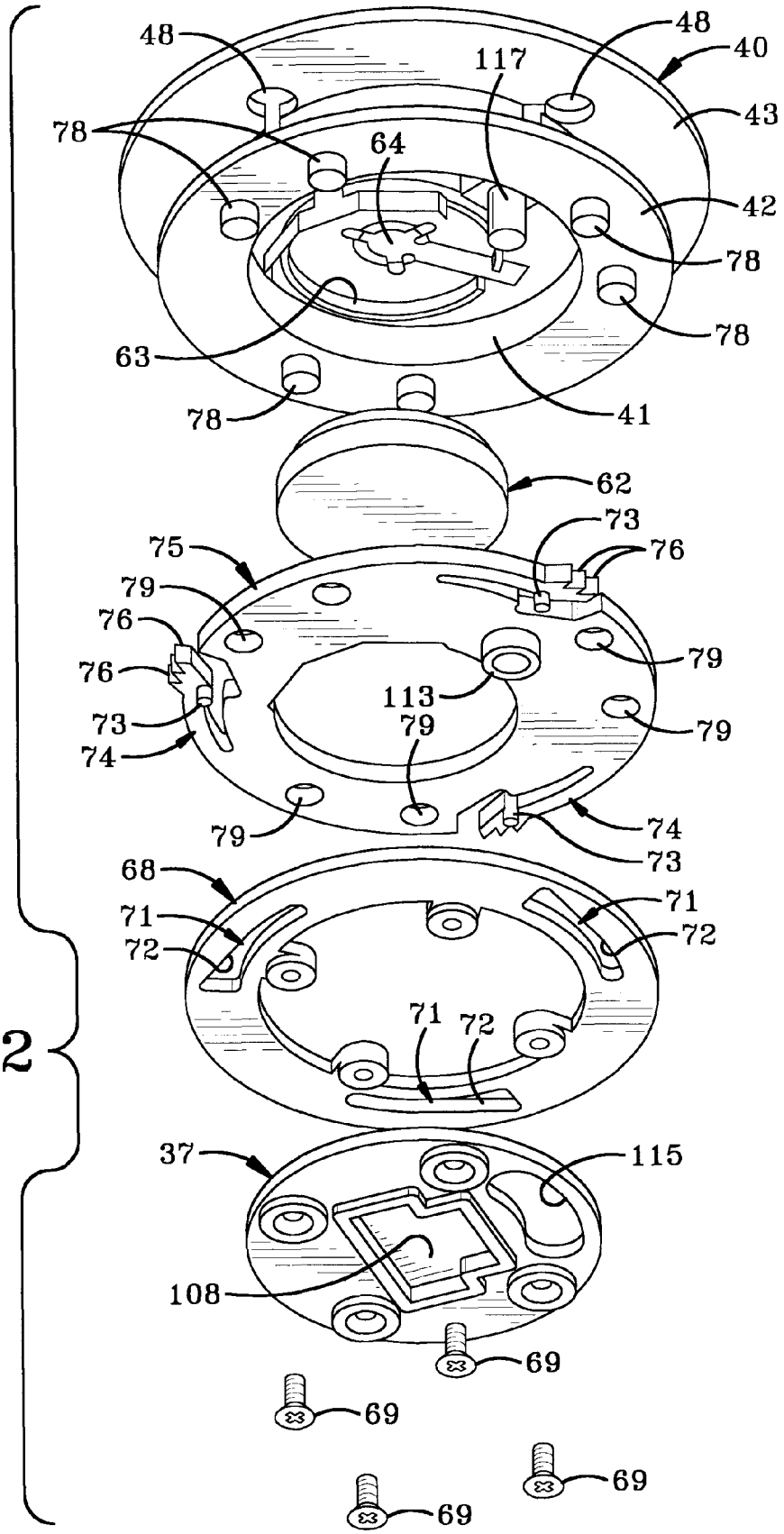
FIG. 12 is an exploded perspective view of various components of the ratchet mechanism.

Ratchet mechanism 4 further includes a locking disc indicated generally at 68 (FIG. 12), which is secured to pawl release plate 37 by a plurality of screws 69 so as to rotate with plate 37. Locking disc 68 is formed with a plurality of arcuate camming slots 71 (FIG. 11) spaced equally circumferentially about disc 68, in which are received a respective camming projection 73 formed on a locking pawl 74, three of which are formed on a gear disc indicated generally at 75 (FIG. 12). Each locking pawl 74 includes one or more locking teeth 76 formed on the distal end of the lever-like arm which forms locking pawl 74. Gear disc 75 is mounted on flange 42 of spool 40 by a plurality of projections or circular tabs 78, six of which are shown in the drawing, which extend through aligned holes 79 formed in gear disc 75, whereby gear disc 75 is rotatable with spool 40. Gear disc 75 is operatively connected to locking disc 68 only through the engagement of camming projections 73 extending into camming slots 71 as discussed further below.

Top wall portion 57 of ratchet mechanism 4 is rotatably mounted within a top opening of housing 27 by a lock ring 81 (FIGS. 7 and 8), which preferably is attached to housing side wall 28 by a sonic weld, an adhesive, etc. Three bosses 83 (FIG. 9) are formed on and extend outwardly from the bottom surface of top wall portion 57 and extend through aligned holes 48 formed in spool flange 43 to operationally connect top wall portion 57 with spool 40, whereby rotation of top wall portion 57 will rotate spool 40 therewith.

Figure 7:
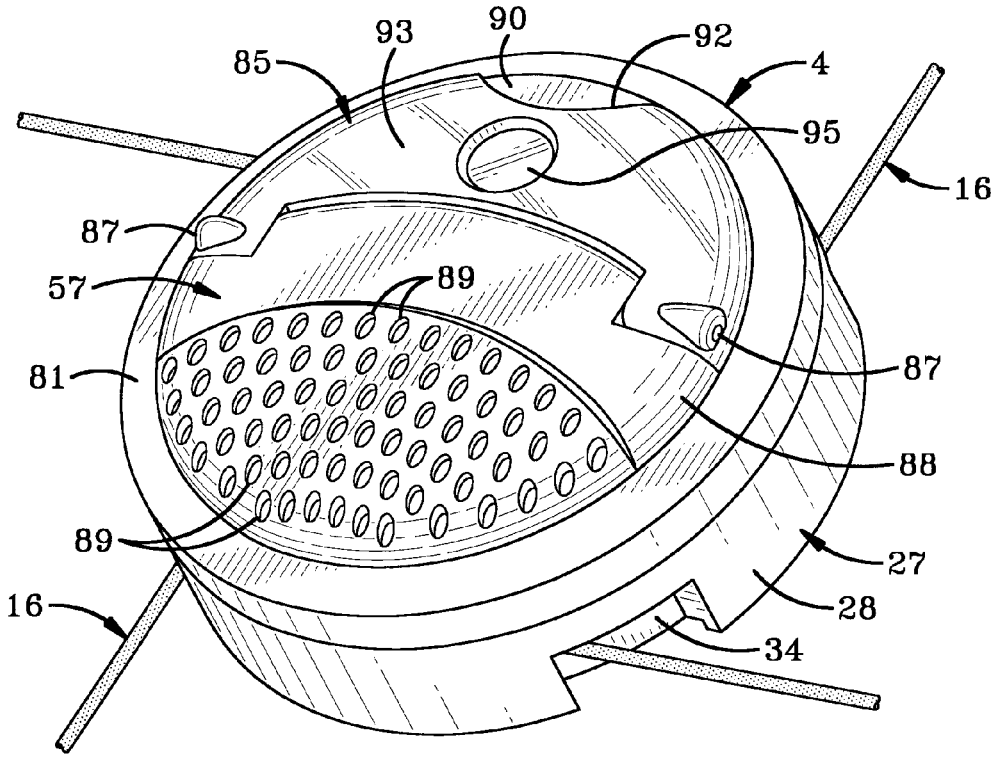
FIG. 7 is a top perspective view of the ratchet mechanism with the flip-up handle in a down inoperative position.
Figure 8:
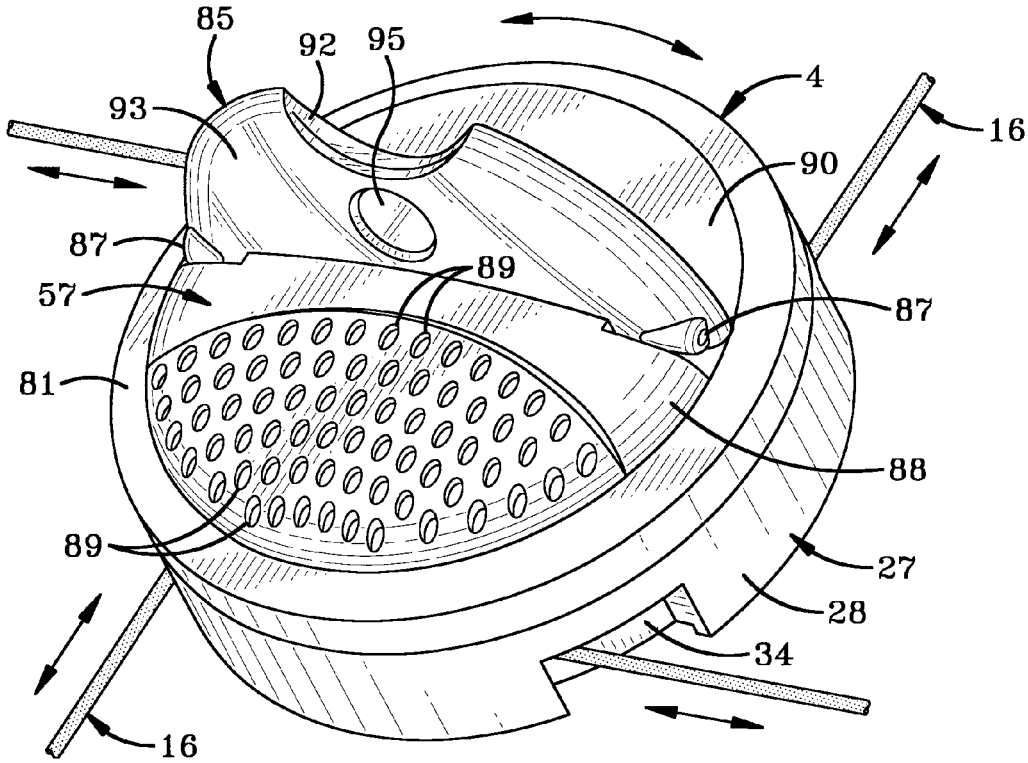
FIG. 8 is a view similar to FIG. 7 with the flip-up handle in a raised operating position.
Figure 9:
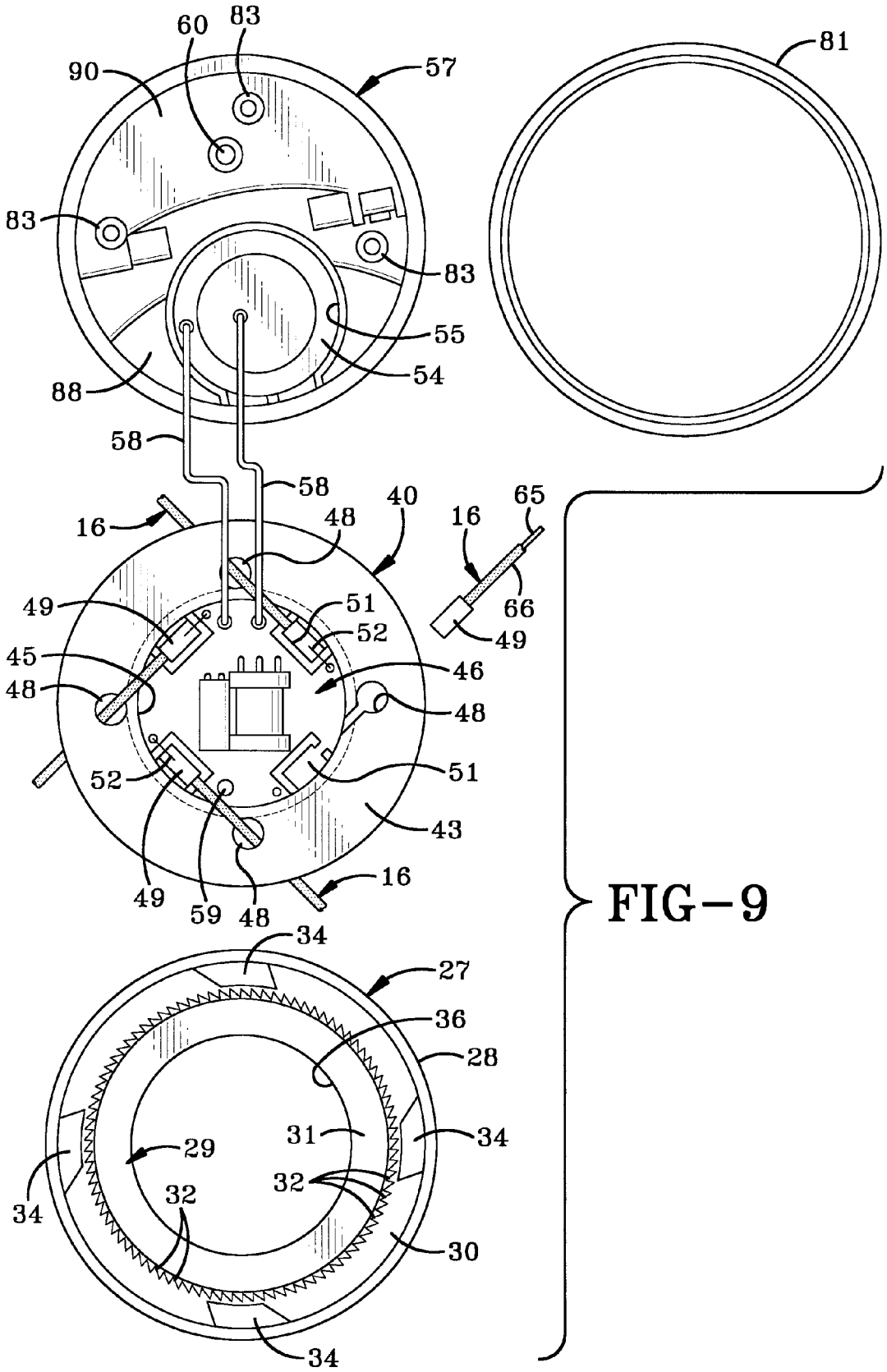
FIG. 9 is an exploded view of portions of the housing, cable spool, top wall cover plate, gear housing and lock ring of the ratchet mechanism.
Figure 10:
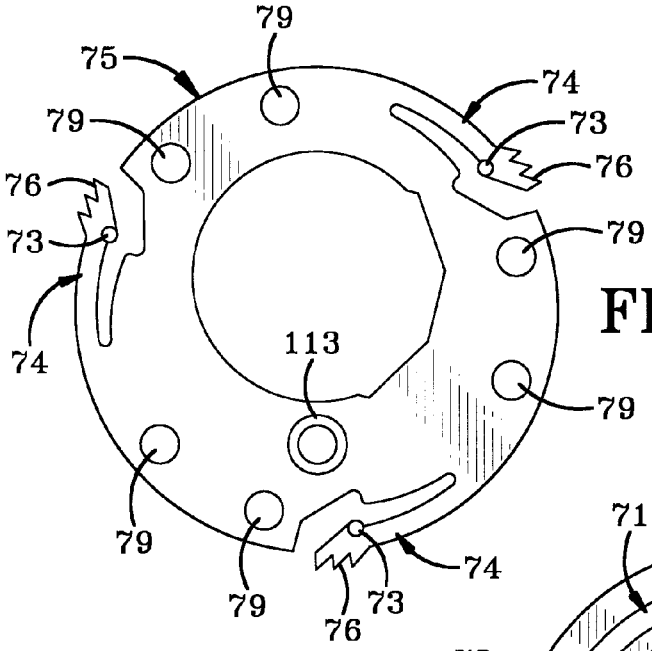
FIG. 10 is a bottom plan view of the gear disc removed from the ratchet mechanism spool.
Figure 11:
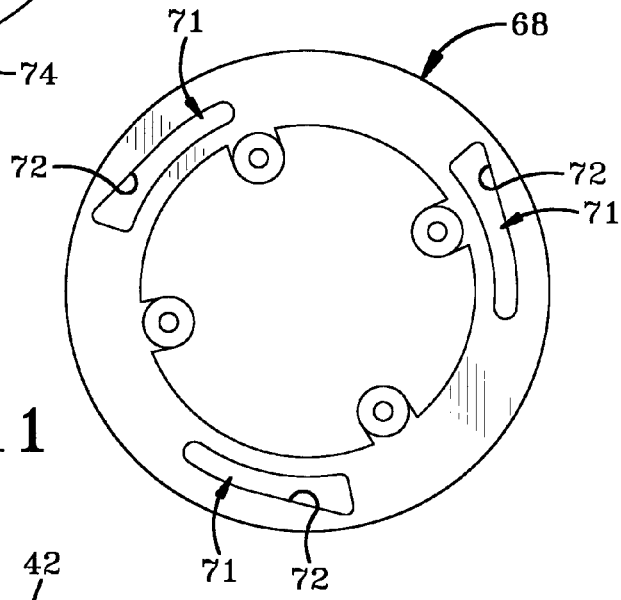
FIG. 11 is a bottom plan view of the locking disc removed from the ratchet mechanism spool.
Figure 13:
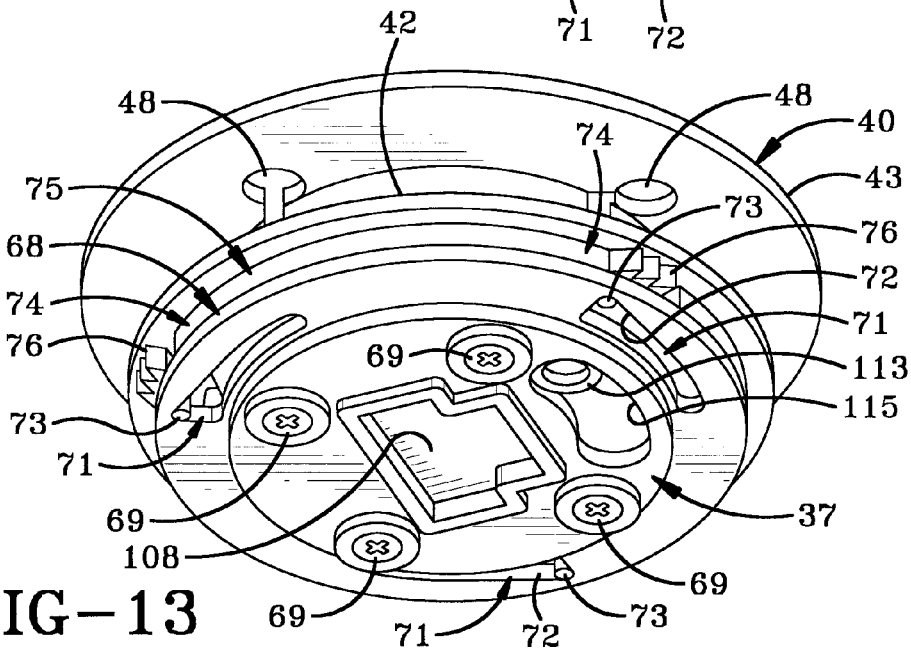
FIG. 13 is an assembled view of the ratchet mechanism components shown in FIG. 12.

In accordance with one of the features of the present invention, a flip-up handle indicated generally at 85, is mounted on top wall portion 57 and is moved from a down generally inoperative position as shown in FIG. 7, to a raised operative position as shown in FIG. 8. Handle 85 is pivotally mounted by a pair of pivot pins 87 to a half dome-shaped portion 88 of top wall portion 57. A plurality of perforations or holes 89 preferably are formed in dome-shaped portion 88 and align with the audible alarm speaker 54 mounted adjacent thereto as shown in FIG. 9. A generally planar semicircular portion 90 forms the other half of top wall portion 57 and receives the flip-up handle 85 when the handle is in the down position as shown in FIG. 7. Handle 45 preferably is formed with a concave finger grasping area 92 so that a user can easily grasp the flip-up handle for moving it between the down position of FIG. 7 to the operable position of FIG. 8. Handle 85 preferably has a smooth curved top surface 93, having a curvature generally matching that of half dome-shaped portion 88, to provide for a smooth attractive appearance to the ratchet mechanism so that it does not distract appreciably from a merchandise display box when secured thereon.

In accordance with another feature of the invention, flip-up handle 85 may be formed of a transparent material and will have a circular lens 95 in the center thereof which aligns with LED 59 when in the down position of FIG. 7. This will help distribute the light of the LED throughout the length of the handle, making it more visible to a perspective shoplifter and to indicate to the store personnel that the alarm system is activated. This translucent or clear plastic construction of handle 85 further increases the esthetics of the ratchet mechanism.

Figure 16:
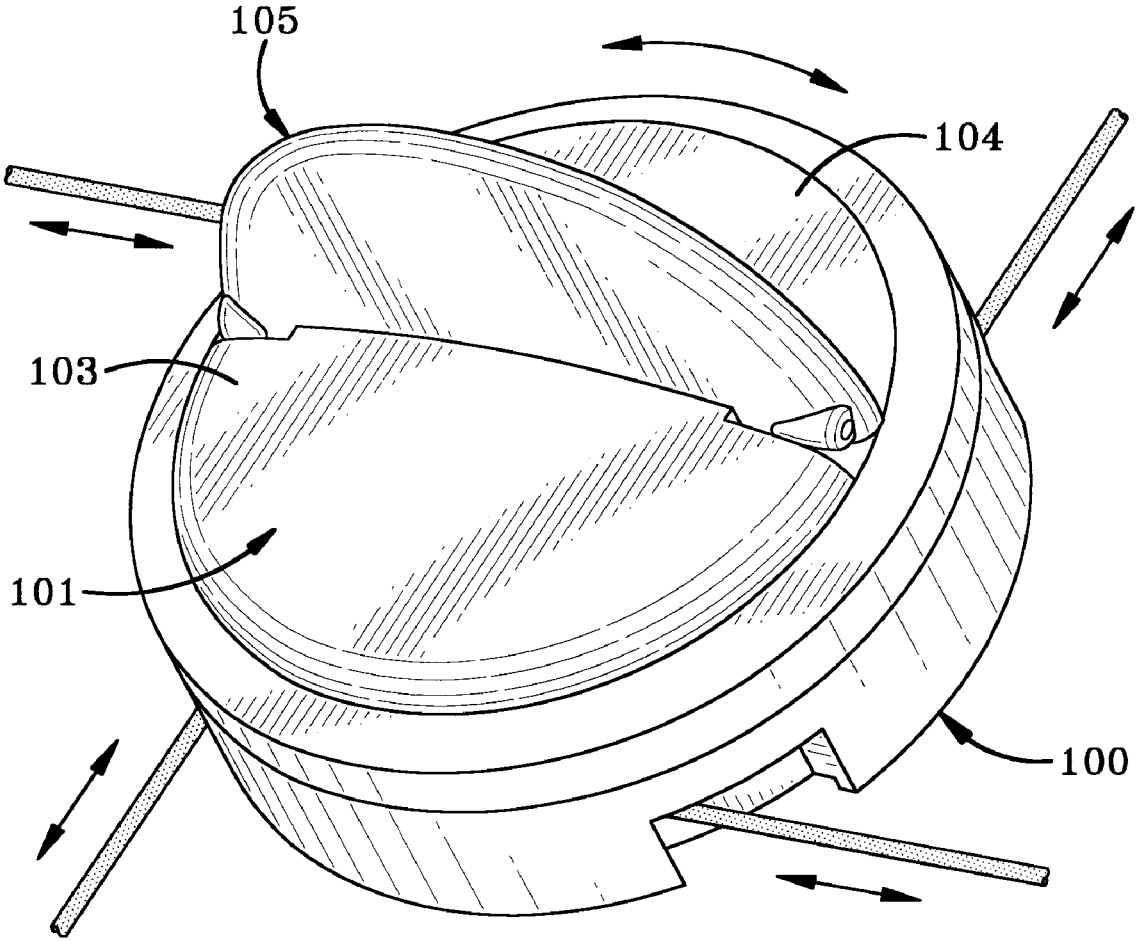
FIG. 16 is a perspective view similar to FIG. 7 of a modified ratchet mechanism with the flip-up handle in a raised operating position.

FIG. 16 shows a modified ratchet mechanism 100 and is similar to ratchet mechanism 4 discussed above except that it does not contain the alarm system, but provides the mechanical locking and unlocking features thereof discussed above and further below. Top wall portion 101 of mechanism 100 preferably includes a semi dome-shaped portion 103 and a semicircular flat portion 104 against which flip-up handle 105 will rest when in a down position (not shown), similar to that discussed above and shown in FIG. 7.

In accordance with another feature of the invention best illustrated in FIGS. 14 and 15, locking member 5, and in particular base 7 thereof, will be formed with a configured end 107 (FIGS. 3 and 4), which is complimentary to a portion of a recess 108 formed in pawl release plate 37. This enables base 7 to rotate plate 37 from a locked position of FIG. 14 to the unlocked position of FIG. 15. In the locked position of FIG. 14, locking teeth 76 of locking pawls 74 are engaged with ratchet teeth 32 of housing 27 to prevent movement of spool 40 toward an unlocked position, in which position cables 16 can be loosened and removed from package 2. Using a portion of locking member 5 as an unlocking key to place the spool in a free wheeling position eliminates the need for a separate key or mechanism.

The operation of the improved security device is as follows. The device is installed on package 2 by wrapping cable loops 15 and 17 around the package as shown in FIGS. 1 and 2, such that locking member 5 preferably lies on one of the major panels of the package and ratchet mechanism 4 lies on an opposite major panel of the package. Fastener 8 is slidably inserted into base 7 where metal tines automatically snap into locked position against shoulders 21. Handle 85 is then pivoted to the up operating position of FIG. 8 and manually rotated. This rotates top wall portion 57 and correspondingly rotates spool 40 which will wrap the cable about hub 41 until the cables are secured tightly about package 2. Locking teeth 76 of locking pawls 74 automatically engage housing teeth 32 as spool 40 rotates until any excess lengths of cable loops 15 and 17 are wrapped about spool hub 41. The alarm system will be automatically actuated and the sensing loops through cable loops 15 and 17 will be operational due to the contact of enlarged metallic ends 49 with the circuit board 46.

An EAS tag 110 preferably is located within internal chamber 9 of base 7 and will provide the additional security of actuating a secured gate alarm, such as at the exit of a retail store, should an unauthorized person attempt to remove a protected package having security device 1 still wrapped thereabout from the store.

To remove security device 1 from package 2 as at a checkout counter of a retail establishment, magnetic key 23 is placed in the correct position on locking member 5 by use of alignment projections 25 to move tines 12 to the unlocked position as shown in FIG. 4, enabling fastener 8 to be slid from within base 7. The cable loops can then be removed easily from around the package which is then given to a customer after payment, for removal from the retail establishment.

In accordance with another feature of the invention, device 1 is useable on various size packages. Depending upon the size of package 2 from which security device 1 is removed, it can be placed easily around a larger package by placing spool 40 in a free wheeling position. This enables the cable to be unwound easily by rotating spool 40 in an unlocking direction. This is achieved by placement of configured end 107 of locking base 7 in recess 108 of pawl release plate 37 and rotating it from the locked position of FIG. 14 in a counterclockwise direction as shown by Arrow A, to the unlocked position of FIG. 15. This rotational movement will rotate locking disc 68 due to its connection by screws 69 to plate 37, which will cause camming projections 73 of gear disc 75 to move along a surface of camming slots 71. Slots 71 are configured whereby the position of projections 73 will move radially inwardly as they move along slot surfaces 72, moving with them the distal ends of locking pawls 74 radially inwardly which will disengage gear teeth 76 from housing gear teeth 32. This enables spool 40 to rotate freely, enabling the cables to be pulled very easily to a longer length. This is accomplished without the use of a key or other mechanism separate from the security device to disengage the locking pawls from the housing gear teeth. Once the desired length of cable has been pulled outwardly from ratchet mechanism 4 by the free wheeling effect of spool 40, pawl release plate 37 is moved again from the unlocked position of FIG. 15 to the locked position of FIG. 14, by the use of the configured end 107 of locking member base 7. A hollow boss 113 (FIGS. 10, 12 and 13), which is formed on gear disc 75, extends through a curved opening 115 formed in pawl release plate 37, to limit the rotational movement of plate 37 when moving between the locked position of FIG. 14 and the unlocked, free wheeling position of FIG. 15. A plunger switch 117 (FIG. 12) is electrically connected to circuit board 46 and extends into the hollow interior of boss 113 and is used to test the alarm control system after manufacture and by store personnel.

Figure 17:
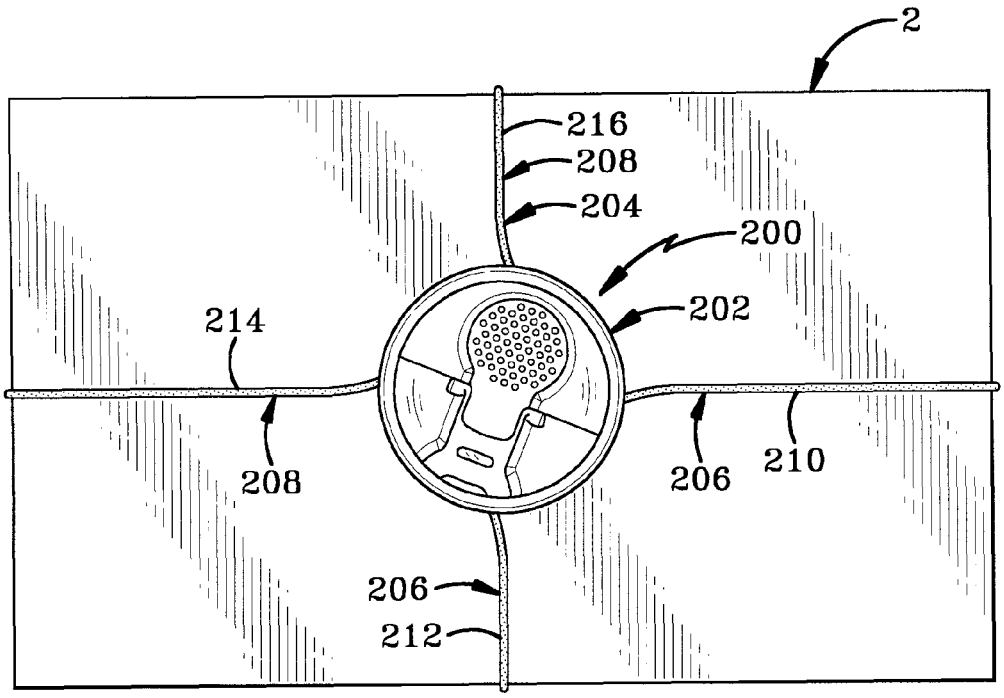
FIG. 17 is a diagrammatic plan view of a second embodiment of the security device secured on a package showing the ratchet mechanism on one side of the package.
Figure 18:
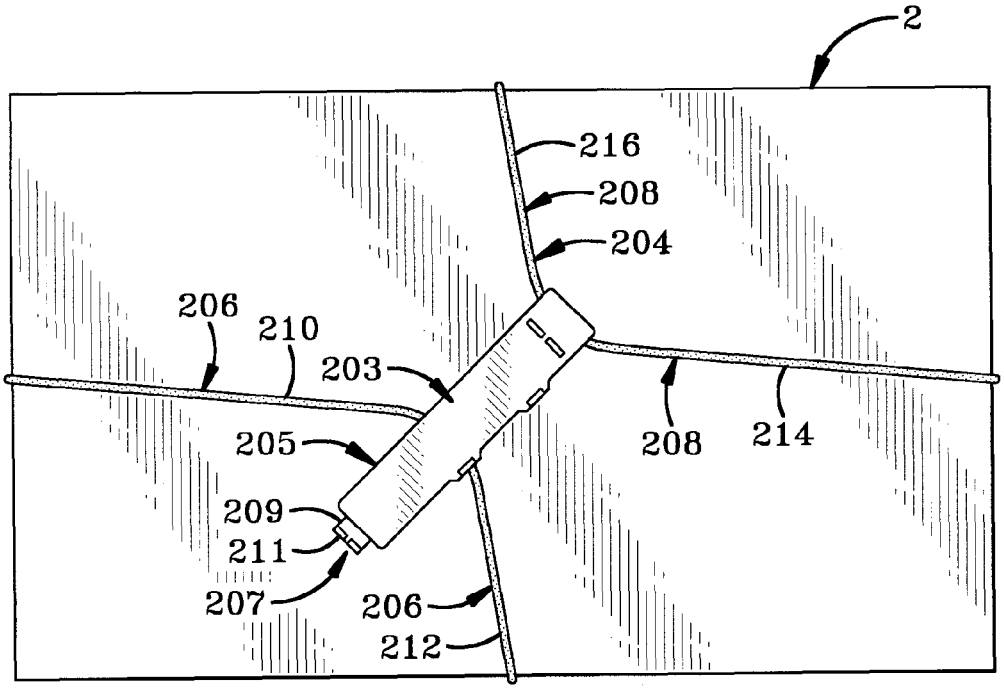
FIG. 18 is a view similar to FIG. 17 showing the locking member located on the opposite side of the package from that of the ratchet mechanism shown in FIG. 1.

Security device 200 (FIGS. 17-18) is similar to device 1 in that device 200 includes two main components. However, device 200 includes a tightening mechanism in the form of a ratchet mechanism 202 which differs in certain regards from ratchet mechanism 202 and a locking member 205 which is the same as locking member 5 except that member 205 includes a base 203 with a key end 207 having a different configuration than that of key end 107 of locking member 5. More particularly, key end 207 (FIGS. 18, 35 and 35A) includes a hollow cylindrical projection 209 and a cross-shaped projection 211, which is partially disposed within and partially projects outwardly from cylindrical projection 209. Otherwise, locking member 205 is the same as locking member 5, which was previously described with reference to FIGS. 3-5. Locking member 205, like locking member 5, thus doubles as a key member for unlocking ratchet mechanism 202. Device 200 further includes a securing cable 204 which includes first and second cable loops 206 and 208. Cable loop 206 includes first and second cable segments 210 and 212 each extending between and connected to ratchet mechanism 202 and locking member 205. Likewise, cable loop 208 includes third and fourth cable segments 214 and 216 each extending between and connected to ratchet mechanism 202 and locking member 205.

Figure 19:
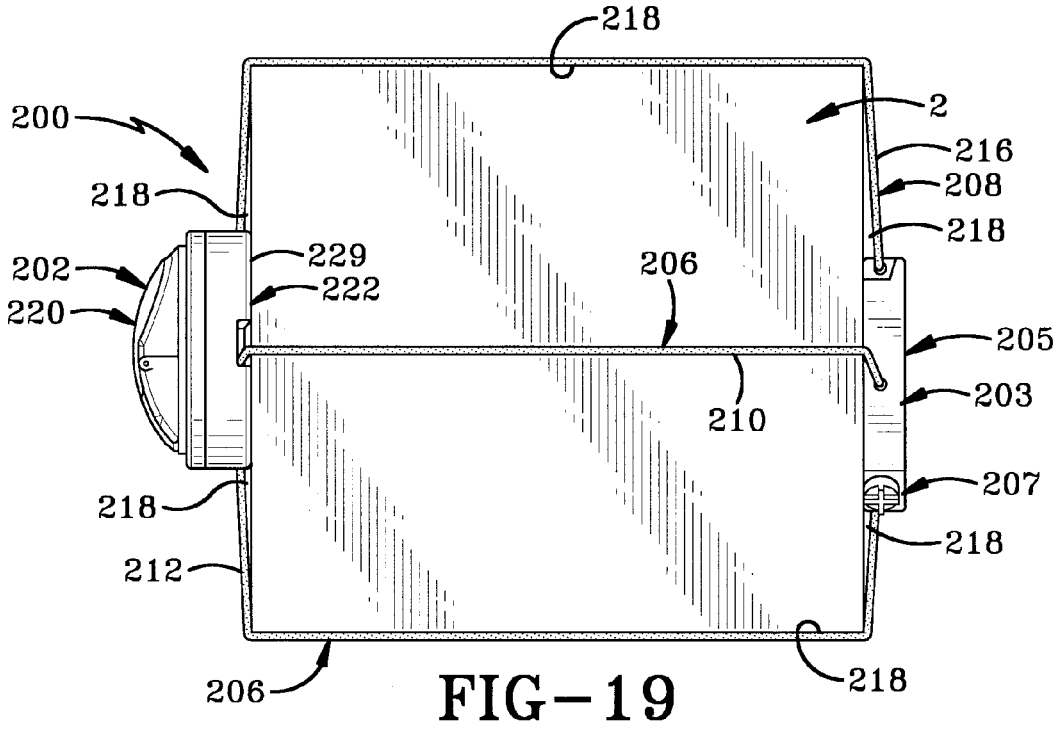
FIG. 19 is an end view of the second embodiment and package shown in FIG. 17.
Figure 20:
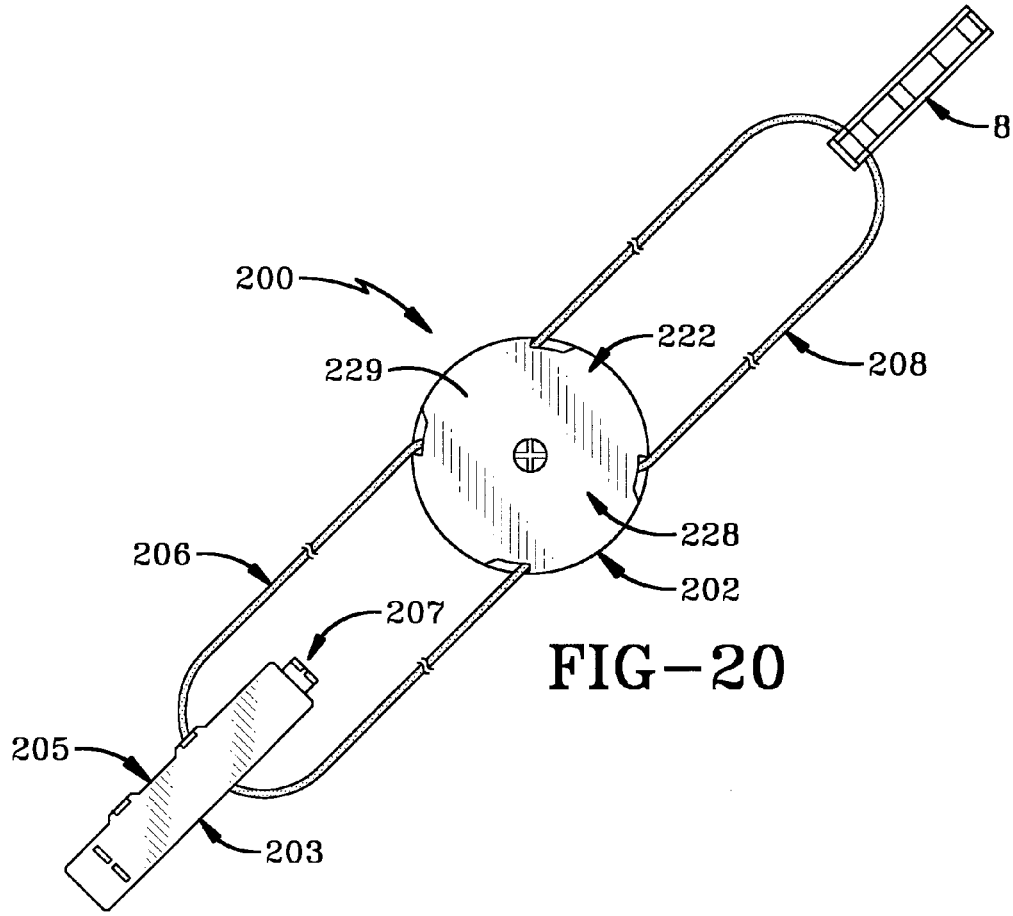
FIG. 20 is a diagrammatic view of the second embodiment in an unsecured position with the base and fastener of the locking member unlocked and released from one another.

Cable 204, and more broadly device 200, is movable between a secured position (FIGS. 17-19) and an unsecured position (FIG. 20). In the secured position, ratchet mechanism 202, locking member 205 and cable 204 define therebetween an object-containing space 218 (FIG. 19) for containing a package 2 or other object to be secured. Ratchet mechanism 202 has a tightening side 220 and an unlocking side 222 which respectively face away from and toward space 218 and package 2 in the secured position. This configuration allows the tightening of cable 204 about package 2 and prevents the unlocking of ratchet mechanism 202 when device 200 is secured about package 2, which blocks or substantially limits access to unlocking side 222 and hides unlocking side 222 from sight to make it more difficult to ascertain how ratchet mechanism 202 is unlocked.

Figure 21:
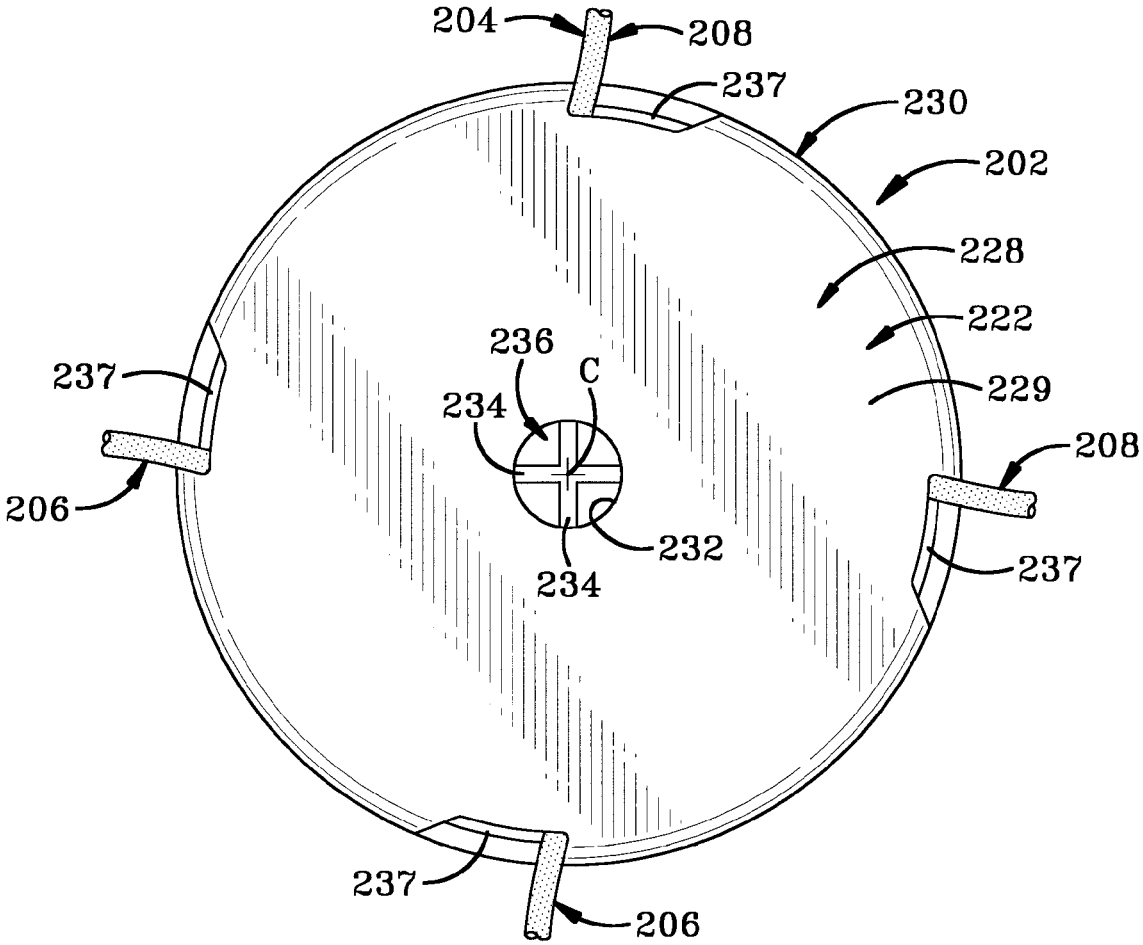
FIG. 21 is a bottom plan view of the ratchet mechanism of FIG. 17 with a fragmentary portion of the securing cables shown extending outwardly therefrom.
Figure 23:
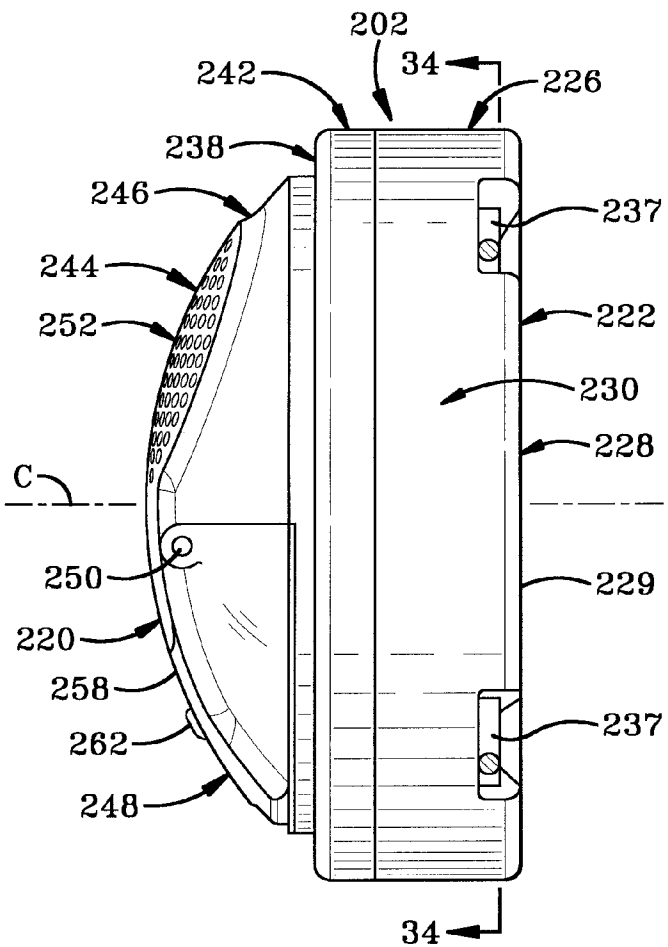
FIG. 23 is a side view of the ratchet mechanism with the flip-up handle in the down position.
Figure 22:
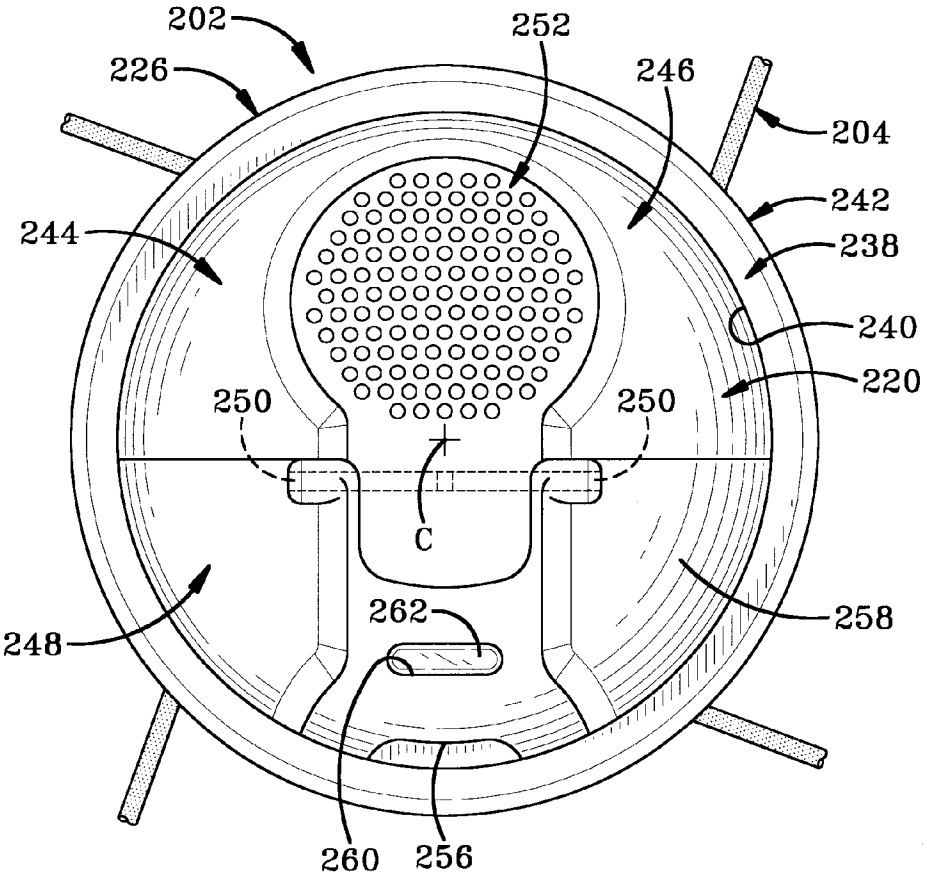
FIG. 22 is a top plan view of the ratchet mechanism with the flip-up handle in a down inoperative position.
Figure 29:
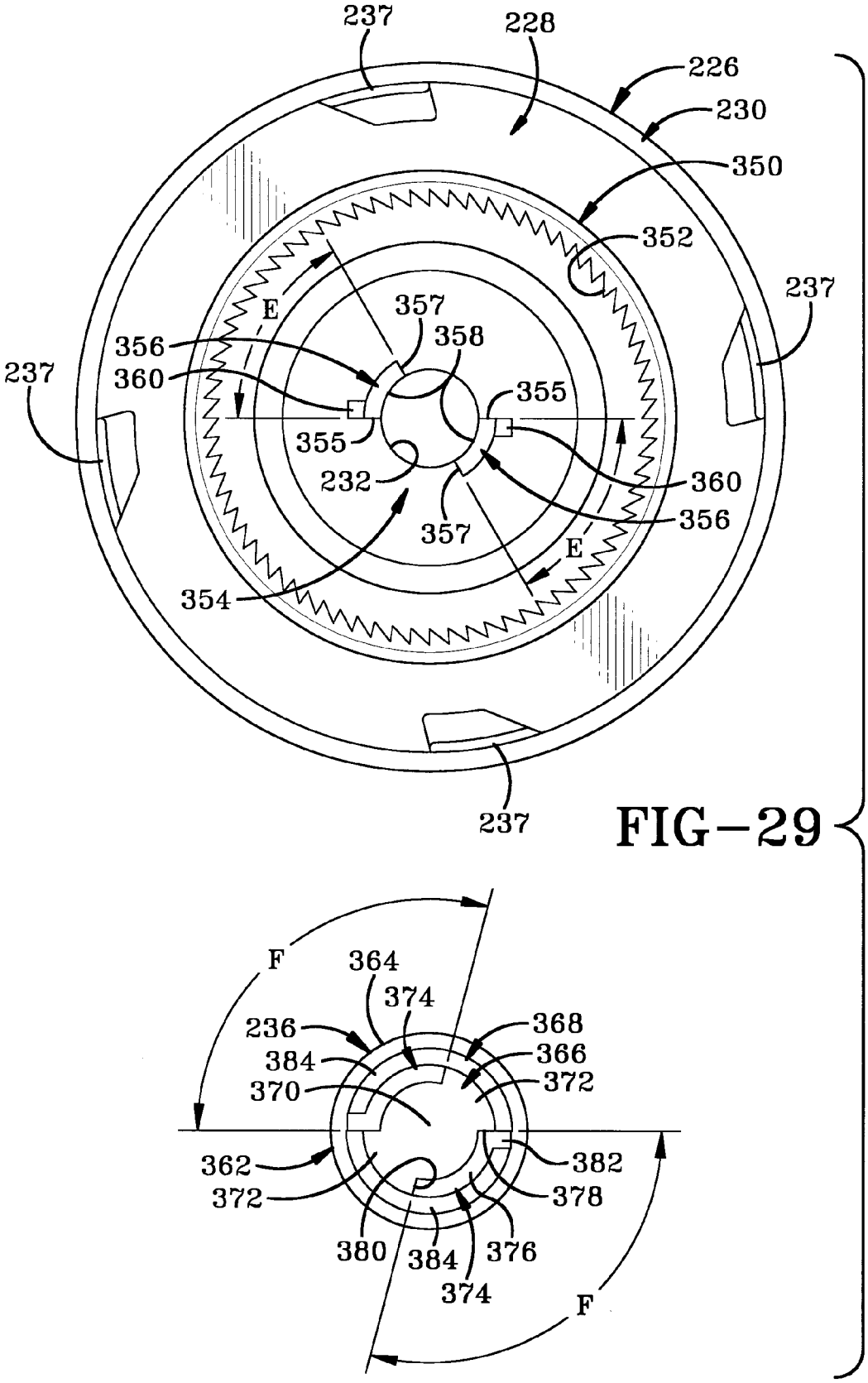
FIG. 29 is an exploded top view of the housing and the locking disk of the second embodiment.
Figures 35, 35A:
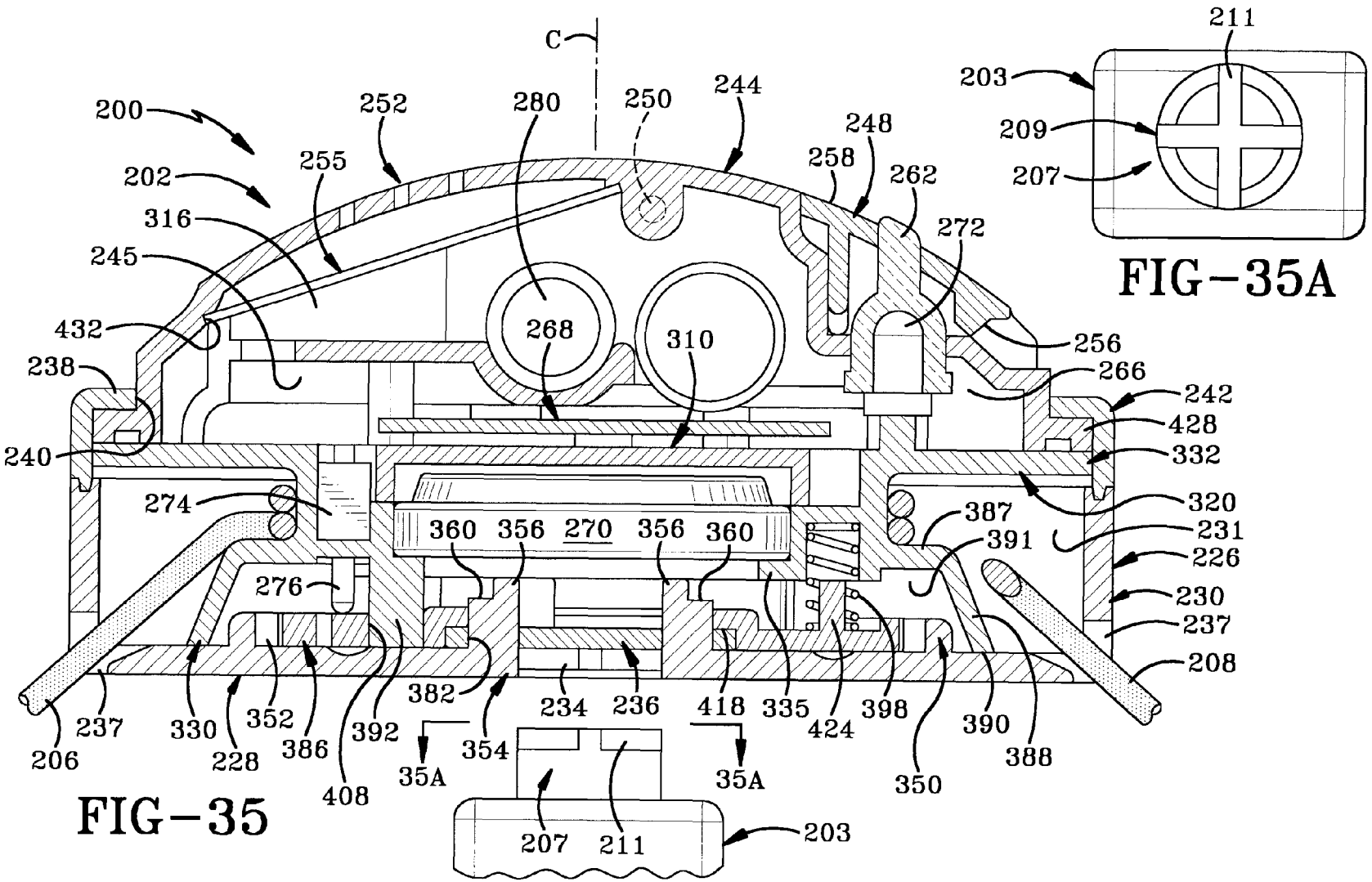
FIG. 35 is a sectional view of the ratchet mechanism taken from the side of the ratchet mechanism in the locked position with the key end of the locking member positioned prior to unlocking of the ratchet mechanism.
FIG. 35A is an end view of the locking member taken on line 35A-35A of FIG. 35.

Ratchet mechanism 202 (FIGS. 21-25) includes a housing 226 which has a substantially flat and circular bottom wall 228 and a cylindrical sidewall 230 which extends upwardly from bottom wall 228 and is concentric about an axis C. Walls 228 and 230 define therewithin a cavity 231 (FIGS. 29, 35). Bottom wall 228 has a substantially flat lower surface 229 which faces object-containing space 218 when device 200 is in the secured position (FIG. 19). Housing 226 preferably is a one-piece member formed of a rugged plastic material. A small downwardly opening circular central opening 232 (FIG. 21) which communicates with cavity 231 is formed in bottom wall 228 for receiving key end 207 of locking member 205. A keying formation 234 (FIG. 21) complementary to key end 207 is visible through opening 232 and is formed in a locking element in the form of a locking disc 236. In the secured position of FIG. 19, formation 234 of disc 236 faces object-containing space 218 and communicates therewith via opening 232. Four cable openings 237 are formed in sidewall 230 adjacent the intersection of sidewall 230 and bottom wall 228 for the passage of securing cable 204 therethrough as discussed further below. Openings 237 open radially outwardly and are preferably spaced circumferentially in a substantially even manner, in the exemplary embodiment being at about 90 degrees to one another with respect to axis C. Housing 226 further includes an annular top wall 238 (FIG. 22) which extends radially inwardly from the top of sidewall 230, is concentric about axis C and defines an upwardly opening circular top entrance opening 240 of cavity 231. Annular top wall 238 and a portion of sidewall 230 are formed by a top ring 242 (FIG. 33) which is fixedly attached to the rest of sidewall 230 by a sonic weld, an adhesive or other suitable means.

Figure 6:
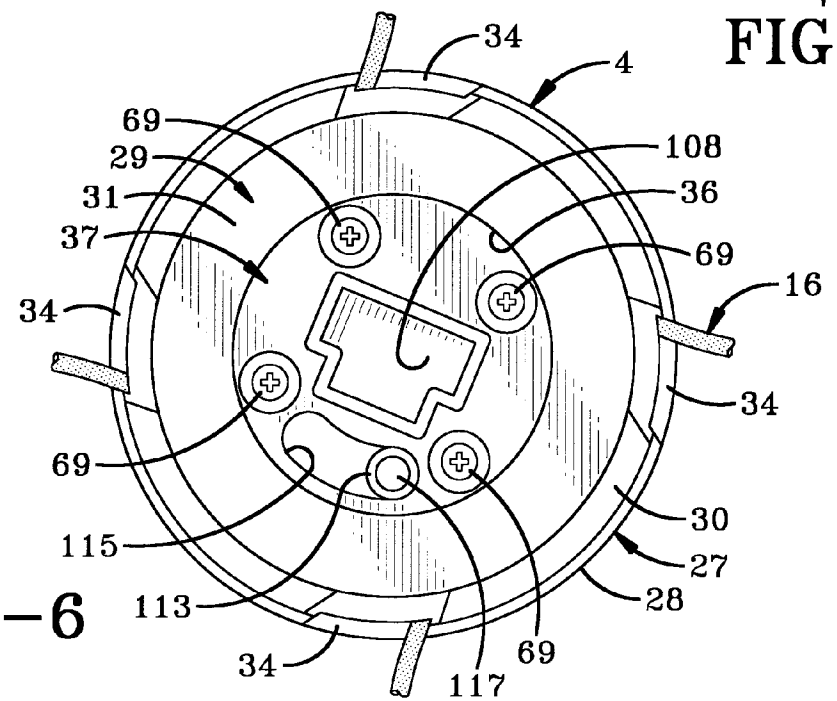
FIG. 6 is a bottom plan view of the ratchet mechanism of FIG. 1 with a fragmentary portion of the securing cables shown extending outwardly therefrom.

Central opening 232 has a diameter which is substantially smaller than the diameter of sidewall 230 and slightly larger than the diameter of cylindrical projection 209 of key end 207. While the dimensions may vary, in one preferred embodiment, sidewall 230 has a diameter of about 22 inches and central opening 232 has a diameter of about ⅜ inch. Small opening 232 makes access to locking disc 236 more difficult when device 200 is secured on package 2 in comparison to access to pawl release plate 37 (FIG. 6) of mechanism 4 of device 1. In addition, the configuration of mechanism 202 eliminates exposure via opening 232 of fasteners such as fasteners 69 of mechanism 4.

Figure 25:
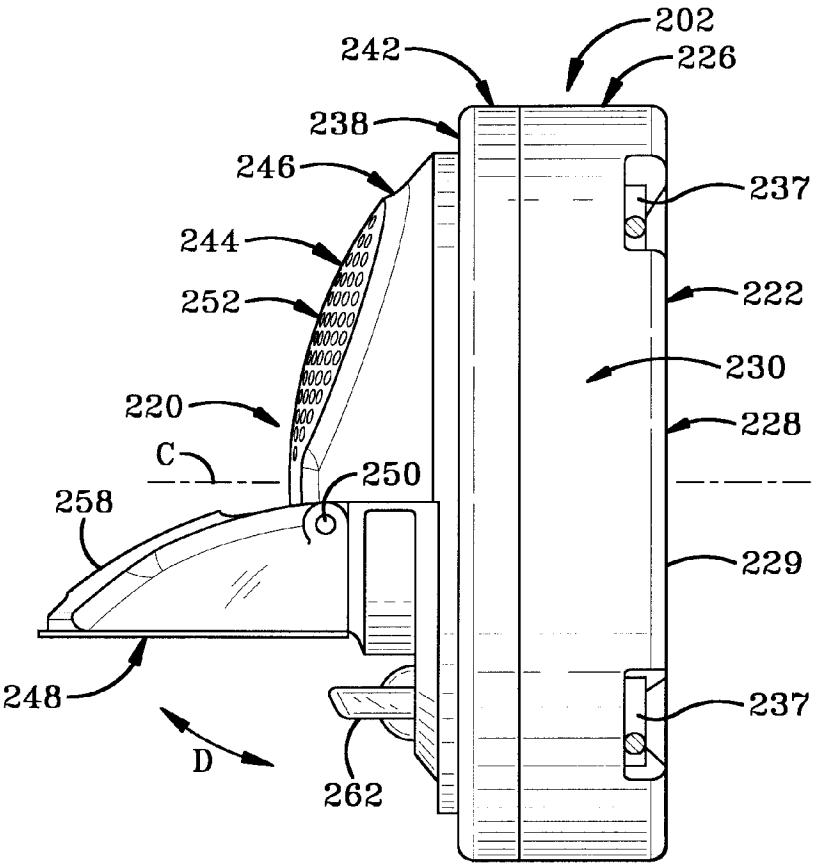
FIG. 25 is similar to FIG. 23 with the flip-up handle in the raised position.
Figure 24:
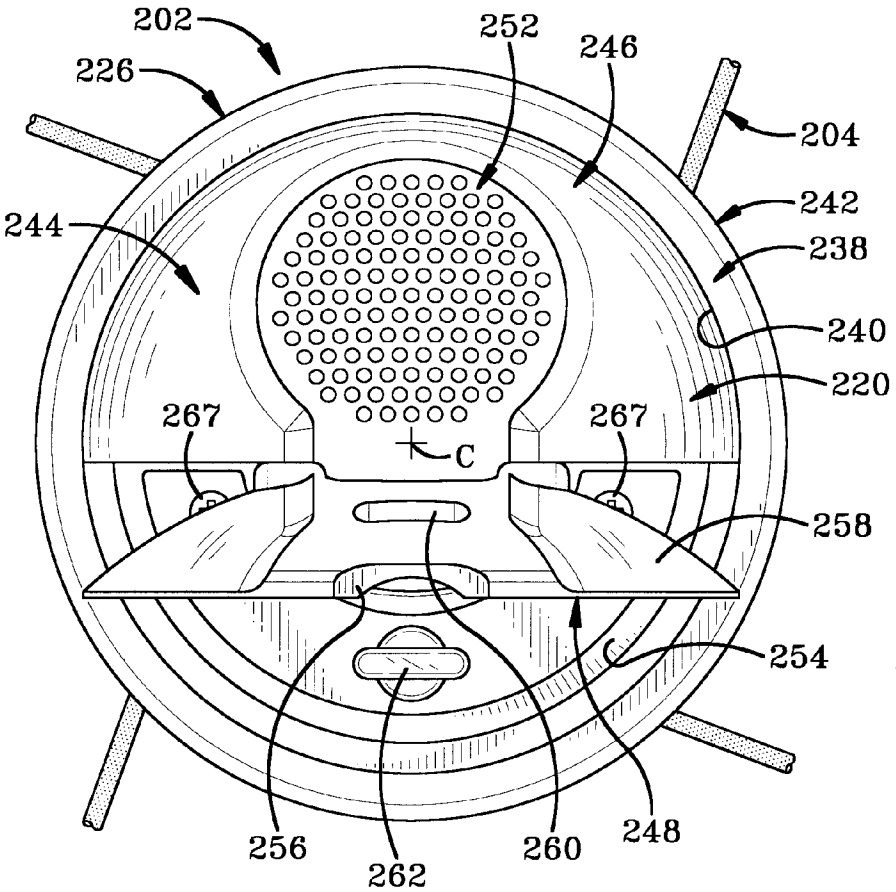
FIG. 24 is similar to FIG. 22 with the flip-up handle in a raised operating position.

Ratchet mechanism 202 further includes a top wall portion 244 which is rotatably mounted within top opening 240 of housing 226 with annular top wall 238 of housing 226 providing an interference to prevent removal of top wall portion 244 upwardly through top opening 240. Top wall portion 244, bottom wall 228 and sidewall 230 define therebetween an interior chamber 245 (FIG. 35) of ratchet mechanism 202. Top wall portion 244 includes a half dome-shaped wall or portion 246 disposed above top wall 238 of housing 226. A flip-up handle 248 is pivotally mounted by a pair of pivot pins 250 on dome-shaped portion 246 and is movable as indicated at Arrow D in FIG. 25 between a down generally inoperative position (FIGS. 22-23) and a raised operative position (FIGS. 24-25). A plurality of speaker holes 252 are formed in dome-shaped portion 246. A generally planar semicircular portion 254 forms the other half of top wall portion 244 and receives the flip-up handle 248 when the handle is in the down position. Handle 248 preferably is formed with a concave finger grasping area 256 so that a user can easily grasp the flip-up handle for moving it from the down position to the raised position. Handle 248 preferably has a smooth half dome-shaped top surface 258, having a curvature generally matching that of half dome-shaped portion 246, to provide for a smooth attractive appearance. Handle 248 defines a through opening 260 for receiving a light pipe 262 which is mounted on portion 254 of top wall portion 244 and extends through an opening 264 formed in portion 254 from above portion 254 into an interior cavity 266 (FIG. 33) of top wall portion 244. Light pipe 262 is a clear or translucent material for transmitting light to the upper surface of top wall portion 244. A pair of mounting screws 267 extend through holes 265 (FIG. 33) formed in portion 254 of top wall portion 244 into interior cavity 266.

Figure 26:
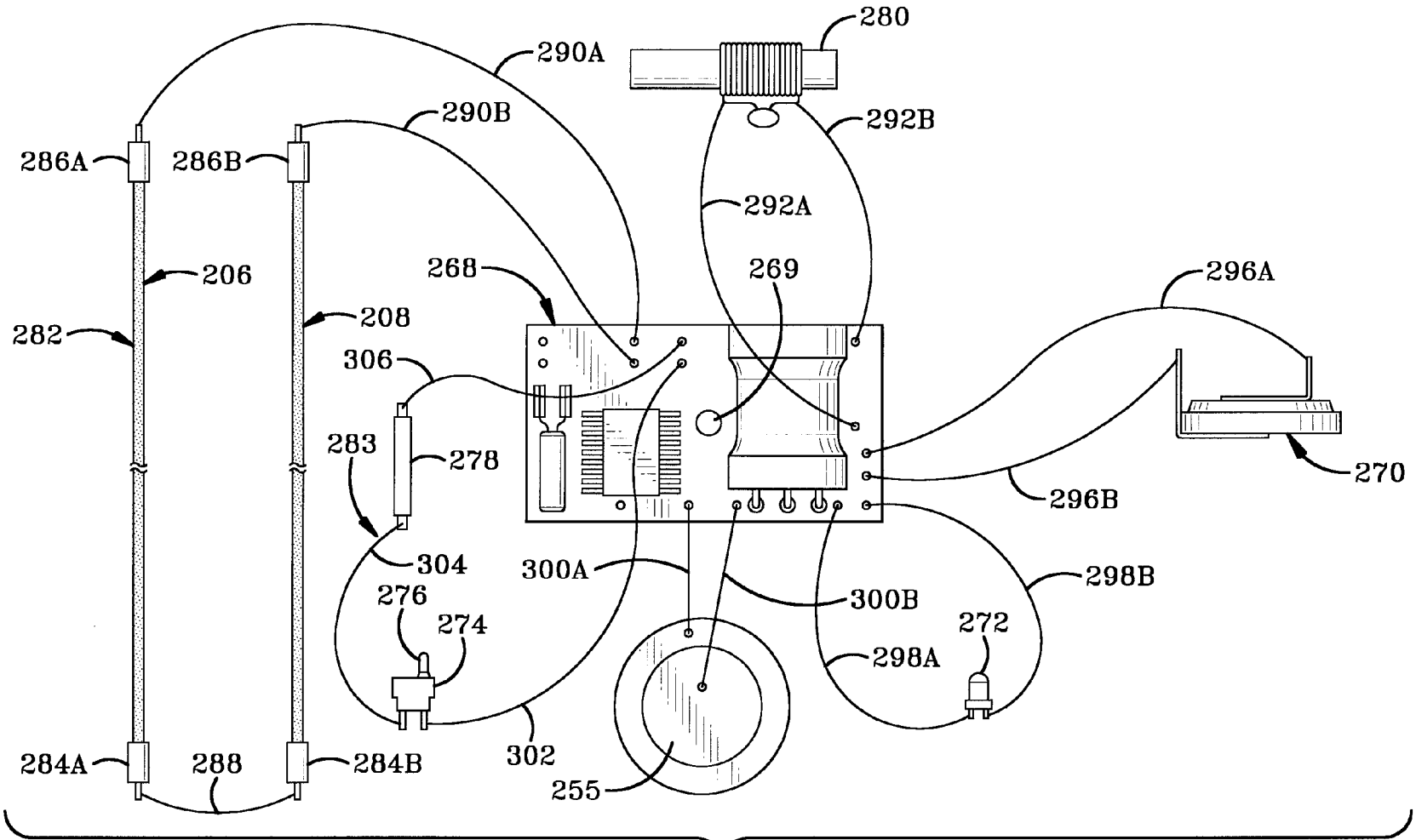
FIG. 26 is a diagrammatic view of the alarming system of the second embodiment.

Device 200 includes an alarm system for producing an audible alarm which sounds under several different circumstances which are described below. Various elements of the alarm system are shown in FIG. 26 and include a printed circuit board (PCB) 268 with which the other alarm elements are in electrical communication. PCB 268 defines an alignment hole 269. The other alarm elements include cable loops 206 and 208, which are electrically conductive, speaker 255, a battery 270 for powering the alarm system, a visual indicating light in the form of LED 272, a pressure switch 274 having a plunger 276, a reed switch 278 and a sensor in the form of an RF or AM coil 280. Cables 206 and 208 respectively include first enlarged metallic ends 284A and 284B and second opposed enlarged metallic ends 286A and 286B. First enlarged ends 284A and 284B are in electrical communication with one another via conductor 288. Second opposed enlarged ends 286A and 286B are respectively in electrical communication with PCB 268 via conductors 290A and 290B. Sensor 280 is in electrical communication with PCB 268 via conductors 292A and 292B; battery 270 via conductors 296A and 296B; LED 272 via conductors 298A and 298B; audible alarm or speaker 255 via conductors 300A and 300B; and switch 274 via conductors 302, 304 and 306 via reed switch 278, which is connected to conductors 304 and 306. In conjunction with PCB 268, cables 206 and 208 along with conductors 288 and 290A and B form a sense loop 282. Another sense loop 283 is formed by PCB 268, switches 274 and 278, and conductors 302, 304 and 306.

Figure 27:
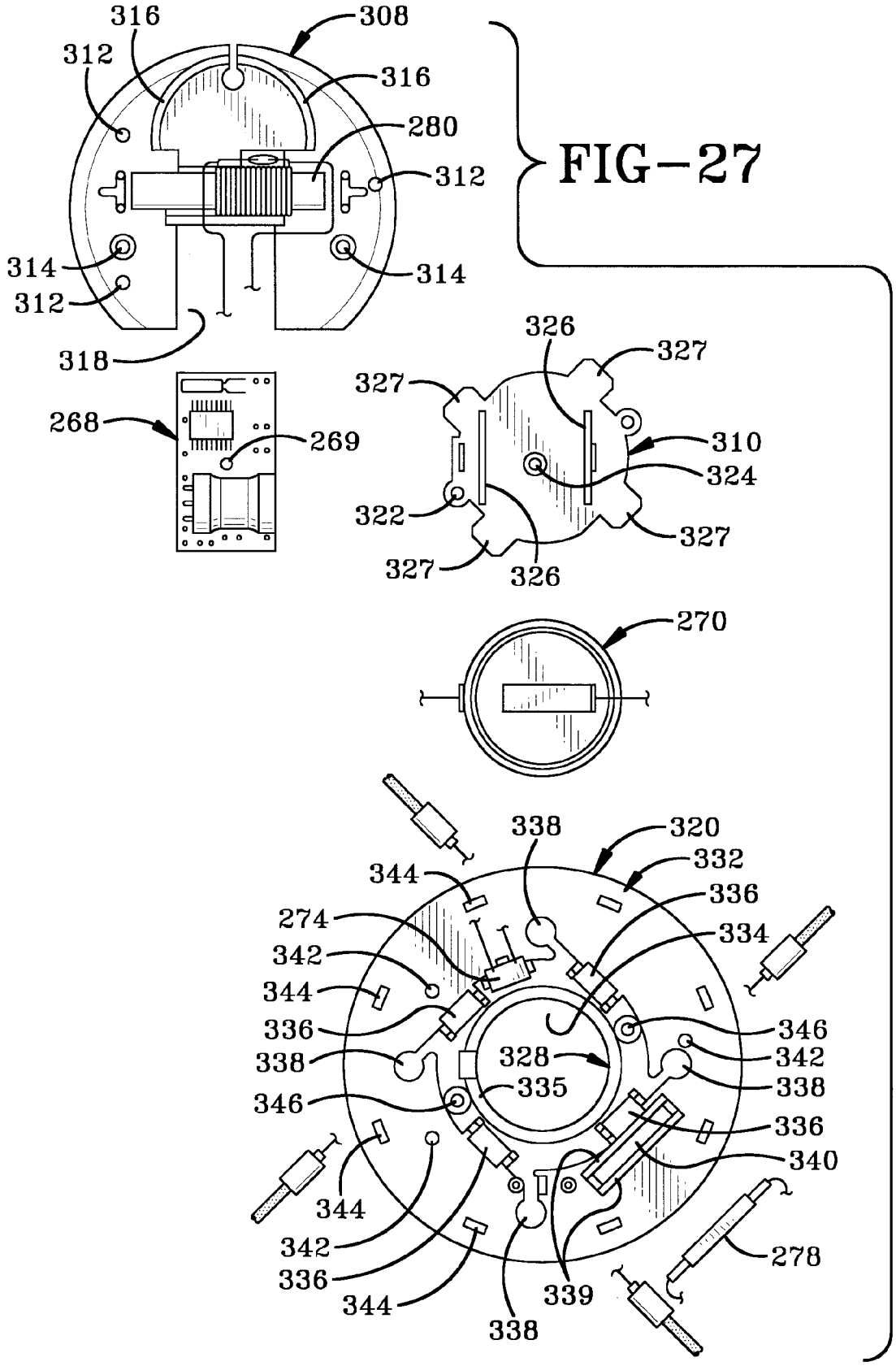
FIG. 27 is an exploded top view of the spool, fragmentary portions of the cable, the battery, the battery cover, the printed circuit board (PCB), and the cover plate.
Figure 28:
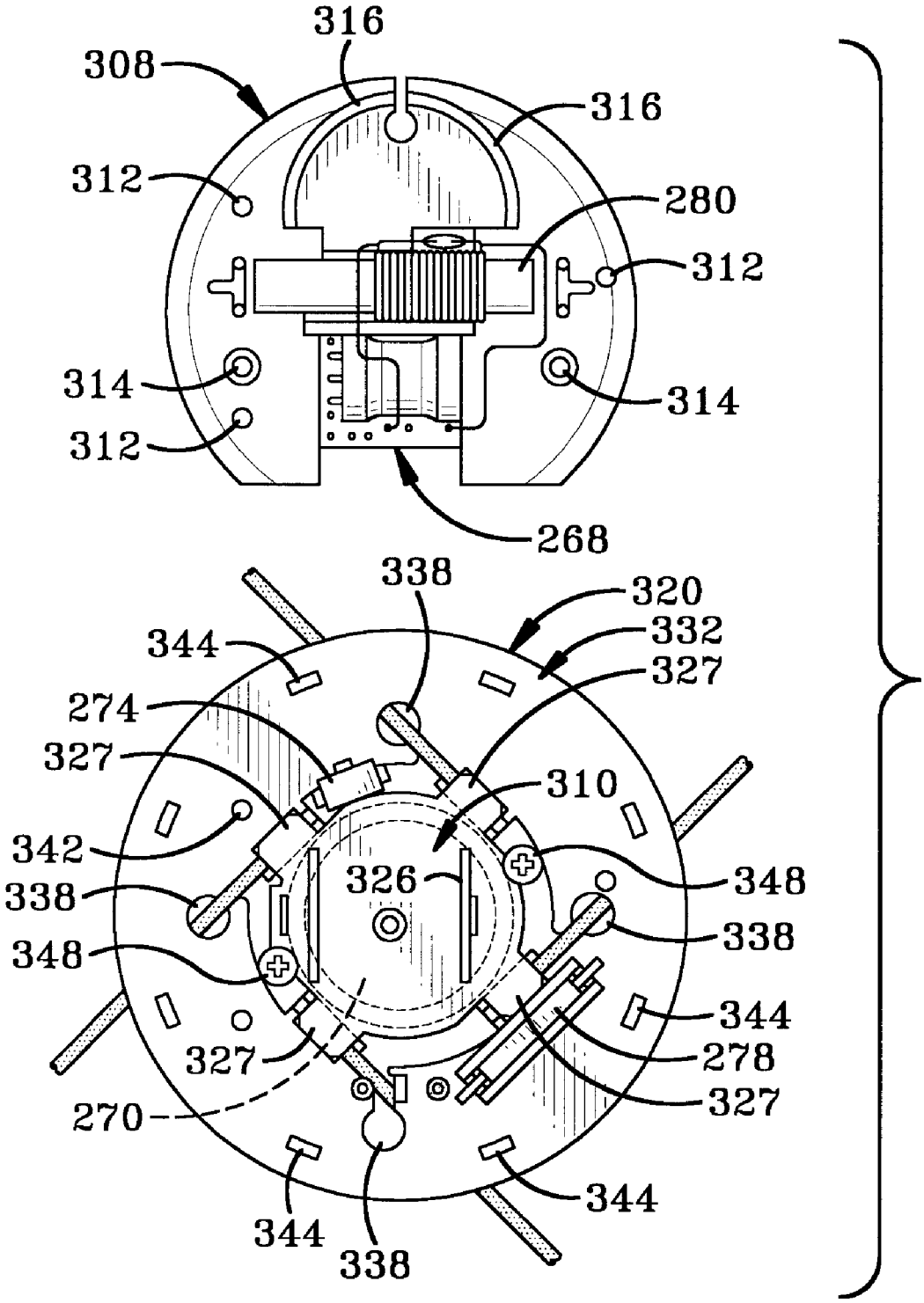
FIG. 28 is an exploded top view showing the elements of FIG. 27 partially assembled wherein the battery, battery cover and cables are mounted on the spool and the PCB is mounted on the cover plate.

With reference to FIGS. 27-28, ratchet mechanism 202 further includes a cover plate 308, a battery cover 310 and a spool 320. Cover plate 308 includes three alignment holes 312 and a pair of mounting holes 314 for receiving screws 267 (FIG. 24) to mount cover plate 308 on top wall portion 244. A pair of upwardly projecting arcuate speaker supports 316 form a substantially semicircular support having a tapered upper surface for supporting speaker 255 in a desired position (FIG. 35) below speaker holes 252. Cover plate 308 further defines a central opening 318 for receiving PCB 268 therein. Battery cover 310 defines a pair of spaced mounting holes 322. Cover 310 includes a central upwardly extending alignment post 324 which is received in alignment hole 269 of PCB 268 when assembled (not shown). Cover 310 further includes a pair of spaced, parallel upwardly extending alignment tracks 326 disposed on either side of post 324 along which sides of PCB 268 are disposed to help align PCB 268 and cover 310 when assembled (not shown). Cover 310 further includes four alignment tabs 327 which project radially outwardly.

Figure 33:
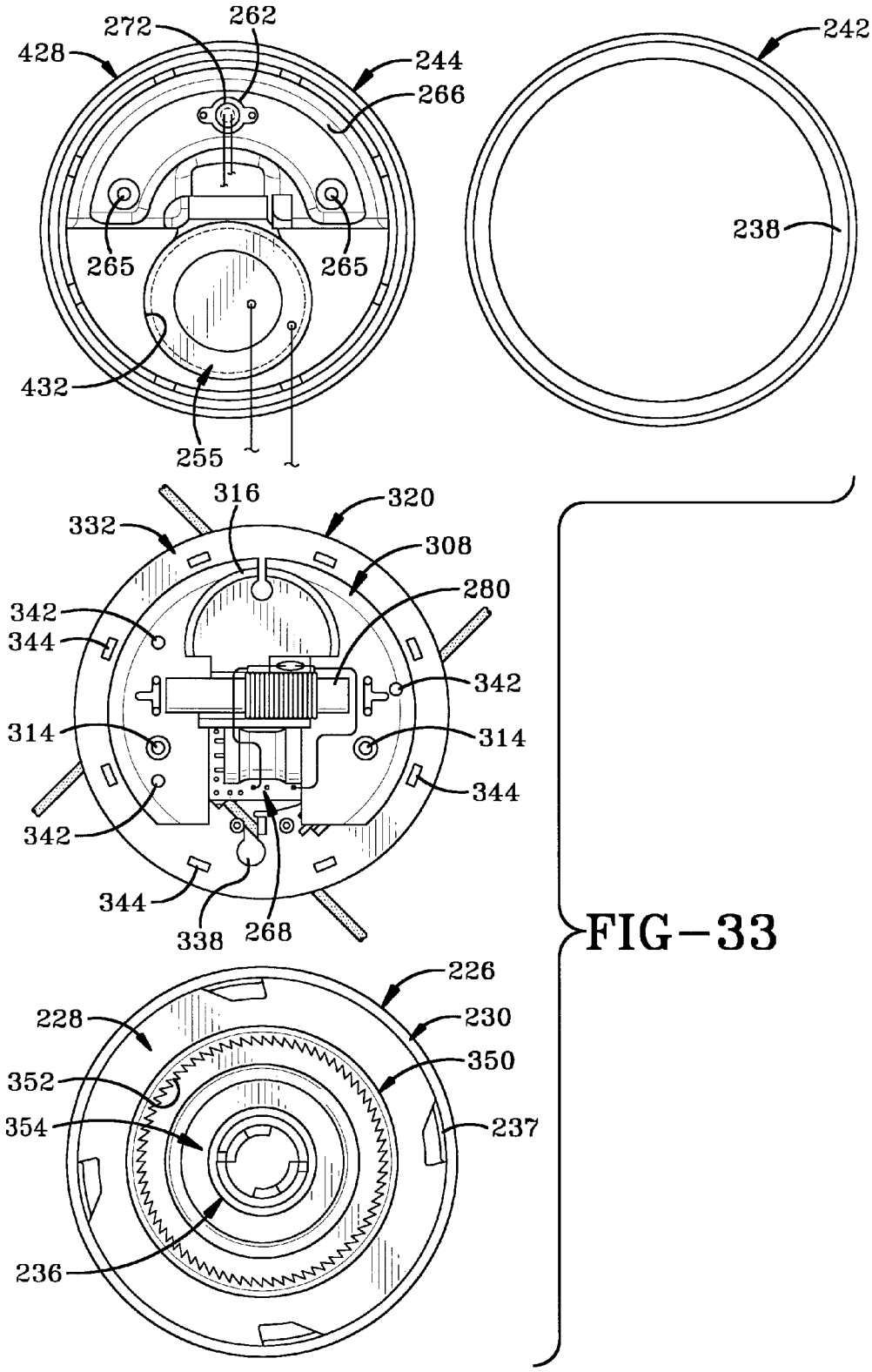
FIG. 33 is an exploded view including a top plan view of the housing with the locking disk mounted therein, a top plan view of the spool with the cover plate and PCB mounted thereon, a bottom plan view of the top wall portion with the speaker and light pipe mounted thereon and a bottom plan view of the lock ring.

Spool 320 (FIGS. 27, 30 and 35) is disposed in cavity 231 of housing 226 and includes a central hub 328 and first and second spaced flanges 330 (FIGS. 30, 35) and 332 extending outwardly therefrom and spaced from each other for capturing cable 204 therebetween when the cable loops 206 and 208 are tightened about package 2. First flange 330 is a lower flange which extends radially outwardly and then angles downwardly and outwardly. Second flange 332 is an upper flange which is substantially flat along a plane perpendicular to axis C. Spool 320 preferably is a one-piece member molded of a rigid plastic material. Hub 328 defines a circular central recess 334 into which battery 270 is press fit atop an annular ledge 335. Four slotted holes 338 are formed in flange 332 and communicate with cable openings 237 for inserting enlarged ends 284 and 286 of cable loops 206 and 208 therethrough. Small compartments 336 are formed in spool 320 adjacent the intersection of upper flange 332 and hub 328 for receiving respectively therein enlarged ends 284 and 286 (FIG. 28). Tabs 327 of battery cover 310 are also received in respective upper portions of compartments 336. A pair of spaced tracks 339 extend upwardly from upper flange 332 and define therebetween an elevated compartment 340 for receiving therein reed switch 278. Three alignment projections 342 extend upwardly from flange 332 and are received respectively in holes 312 of cover plate 308 (FIG. 33). Flange 332 defines a plurality of rectangular alignment holes 344 adjacent the outer perimeter thereof. A pair of mounting holes 346 are formed adjacent a respective pair of compartments 336 for receiving a respective pair of screws 348 (FIG. 28) which pass through respective mounting holes 322 of battery cover 310 to mount cover 310 on spool 320 (FIG. 28).

In accordance with a feature of the invention and with reference to FIG. 29, housing 226 is further described. Bottom wall 228 includes a first engaging member in the form of an upwardly projecting annular wall 350 having a plurality of one-way locking gear teeth 352 which extend radially inwardly all along the circumference of annular wall 350. Annular wall 350 is concentric about axis C (FIG. 35) and defines therewithin an upwardly opening cavity 353 bounded by bottom wall 228 and in communication with opening 232. Housing 226 includes a retaining mechanism 354 (FIGS. 33, 35) which includes locking disc 236 and a pair of arcuate retaining projections 356 which are connected to and extend upwardly from bottom wall 228 on opposite sides of and closely adjacent central opening 232, passing through and above cavity 353 (FIG. 35). Arcuate projections 356 are elongated along a circumferential path and have respective opposed lateral ends 355 and 357 which define therebetween a circumferential length E. Projections 356 have respective inner surfaces 358 which extend between the respective ends 355 and 357 concentrically about axis C and have substantially the same diameter as that of opening 232. Retaining mechanism 354 further includes a pair of seating ledges 360 which are connected to and extend radially outwardly a short distance respectively from projections 356 adjacent a respective lateral end 355 thereof. Seating ledges 360 also project upwardly from and are connected to bottom wall 228. Ledges 360 are axially shorter than arcuate projections 356, as best seen in FIG. 35. Each projection 356 and ledge 360 is diametrically opposed to the other.

Figure 40:
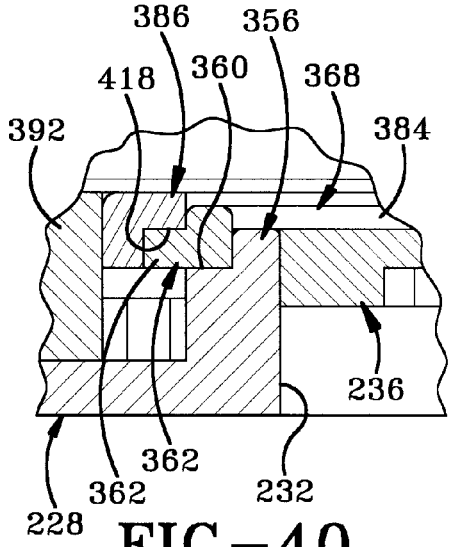
FIG. 40 is an enlarged fragmentary sectional view of a portion of the ratchet mechanism shown in FIG. 38 showing the locking disk in the retained position with the key end of the locking member removed from the ratchet mechanism.
Figure 41:
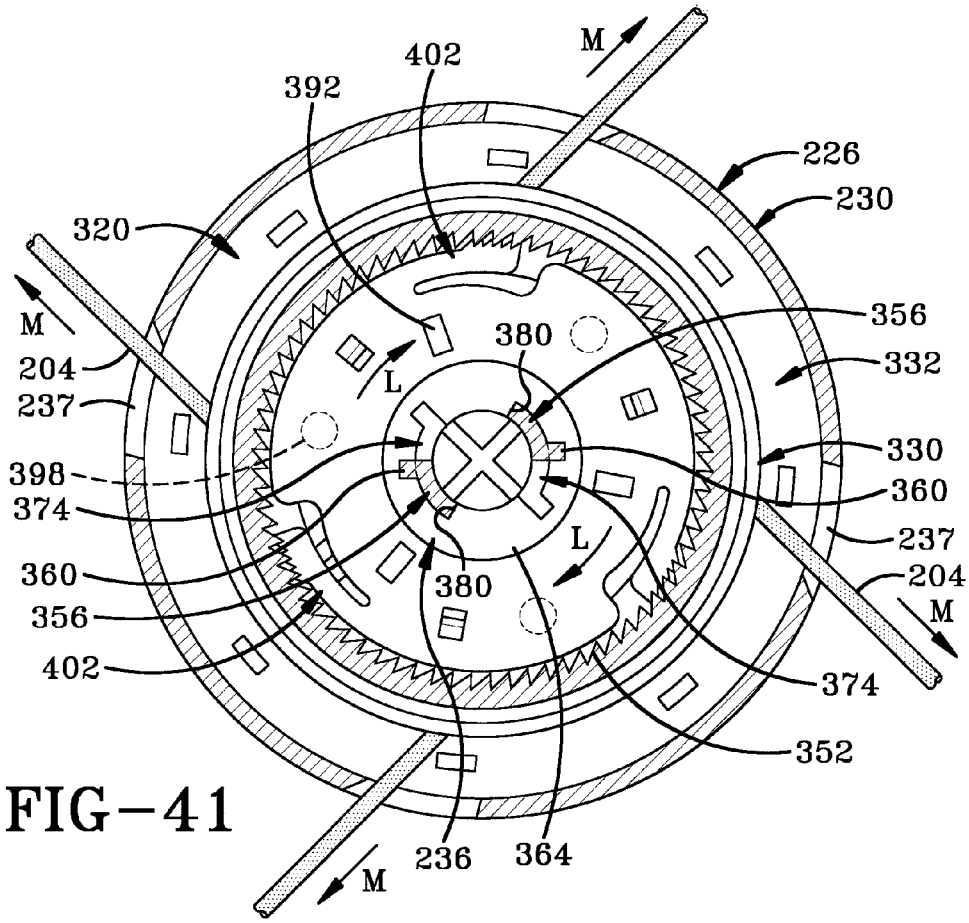
FIG. 41 is similar to FIG. 37 and shows the gear disk and spool in a free wheeling motion to allow the loosening of the cables from the ratchet mechanism.

In accordance with the invention, locking disc 236 (FIGS. 29, 36 and 40) is further described. Disc 236 includes a flat main wall 362 which includes a continuous outer annular wall portion 364 and central wall portion 366. A noncontinuous annular wall 368 projects upwardly from main wall 362 between wall portions 364 and 366. Central wall portion 370 includes a central circular portion 368 and a pair of dovetail portions 372 extending radially outwardly therefrom in opposite directions. Disc 236 defines a pair of diametrically opposed slots 374 each for receiving a respective arcuate projection 356 and ledge 360 therein (FIG. 33). Slots 374 are through slots extending from the top to the bottom of disc 236. Slots 374 include respective arcuate circumferentially elongated slot sections 376 formed in central wall portion 366 for respectively receiving arcuate projections 356 of housing 226. Slot sections 376 are complementary to arcuate projections 356 in that they are concentric about axis C and are slightly radially wider than projections 356 to allow for rotation of disc 236 about axis C with projections 356 in sections 376 when disc is in an unlocked position, as will be detailed further below. Arcuate slot sections 376 are elongated along a circumferential path and are bounded by first and second opposed lateral end surfaces 378 and 380 which define therebetween a circumferential length F which is greater than length E of arcuate projections 356. Length F is longer than length E to a degree sufficient to allow an appropriate amount of rotation of disc 236 in its unlocked position for disc 236 to move to a retaining position which will be detailed further below. Slots 374 further include radial slot sections 382 which are formed in main wall 362 and noncontinuous annular wall 368 for respectively receiving seating ledges 360 therein. Slot sections 382 communicate respectively with slot sections 376 and extend radially outwardly therefrom adjacent respective first lateral end surfaces 378 thereof. Radial slot sections 382 divide noncontinuous annular wall 368 into first and second semi-circular portions 384.

In accordance with the invention and with reference to FIGS. 30-32 and 35, a second engaging member in the form of a gear disc 386 is described and spool 320 is further detailed. Lower flange 330 of spool 320 includes an inner annular wall 387 which extends radially outwardly from hub 328 and is substantially flat along a plane perpendicular to axis C. A frustoconical wall 388 extends radially outwardly and downwardly from annular wall 387 to a lower outer end 390 which abuts the upper surface of bottom wall 228 of housing 226 (FIG. 35) and slidably engages said upper surface during rotation of spool 320. Wall 388 of lower flange 330 guides cable 204 onto hub 328 during tightening of cable 204. Lower flange 330 defines therewithin a flange cavity 391 which when bounded above by battery 270 and below by bottom wall 228 of housing 226 may be considered an interior chamber disposed within interior chamber 245 of ratchet mechanism 202 and within cavity 231 of housing 226 (FIG. 35). Three circumferentially spaced guide bars 392 project axially downwardly from hub 328 within cavity 391 and three circumferentially spaced retaining clips 394 project axially downwardly from hub 328. Guide bars 392 slidably engage bottom wall 228 during rotation of spool 320. Hub 326 defines three circumferentially spaced spring-receiving recesses 396 for receiving respectively therein springs 398. Referring to FIG. 35, annular wall 350, arcuate projections 356 and seating ledges 360 all project upwardly from bottom wall 228 of housing 226 into cavity 391 of lower flange 330. Thus, cavity 353 of annular wall 350 is disposed within and communicates with cavity 391 and central opening 232 of bottom wall 228 communicates with cavity 391. Locking disc 236 and gear disc 386 are also disposed within cavity 391, and plunger 276 and springs 398 extend downwardly into cavity 391.

Figures 30, 31, 32:
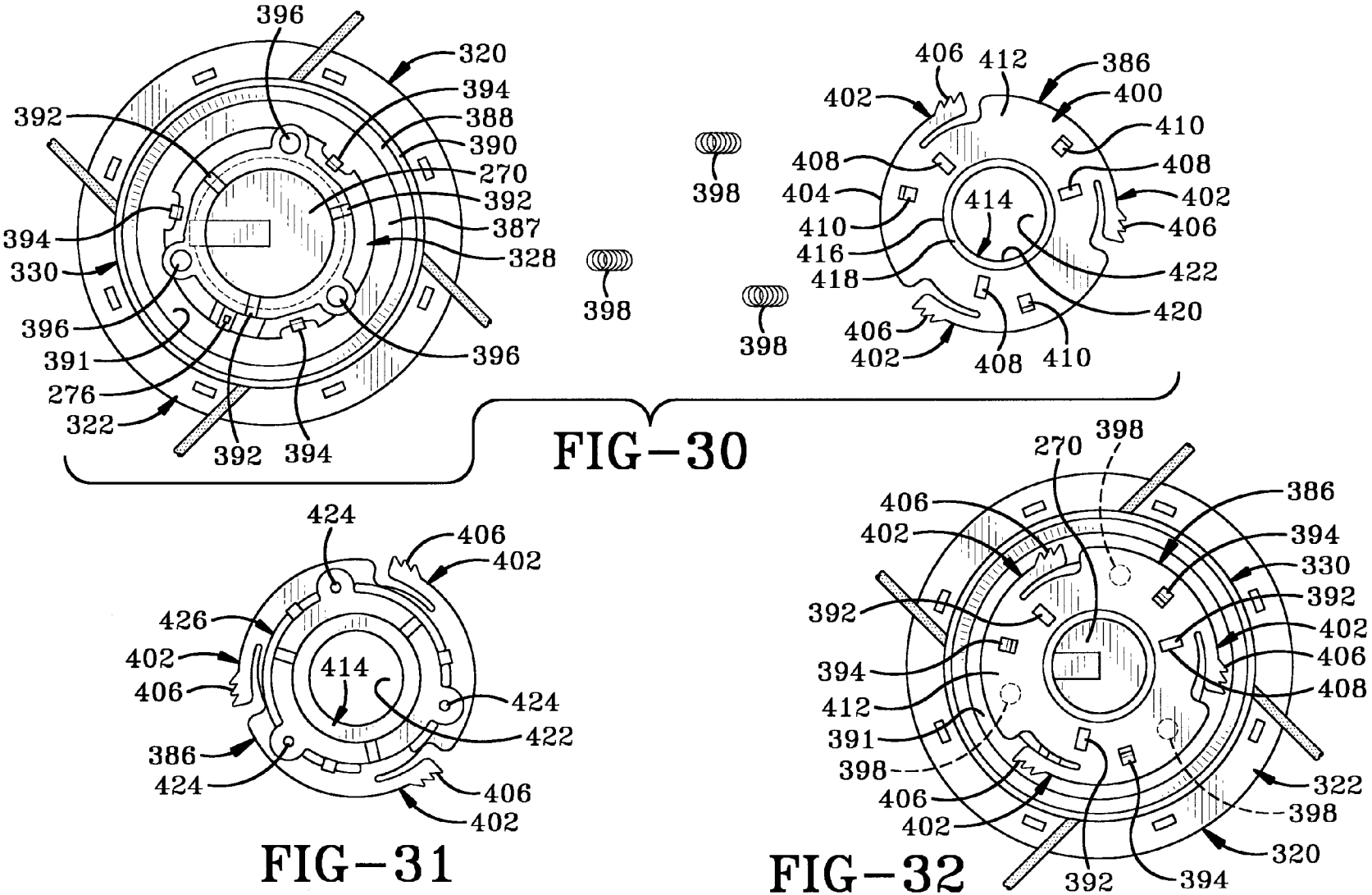
FIG. 30 is an exploded bottom plan view of the spool with the battery mounted thereon with the cables shown in fragmentary extending therefrom, the gear disk and the springs for biasing the gear disk to the locked position thereof.
FIG. 31 is a top plan view of the gear disk.
FIG. 32 is a bottom plan view of the spool with the battery and gear disk mounted thereon.
Figure 36:
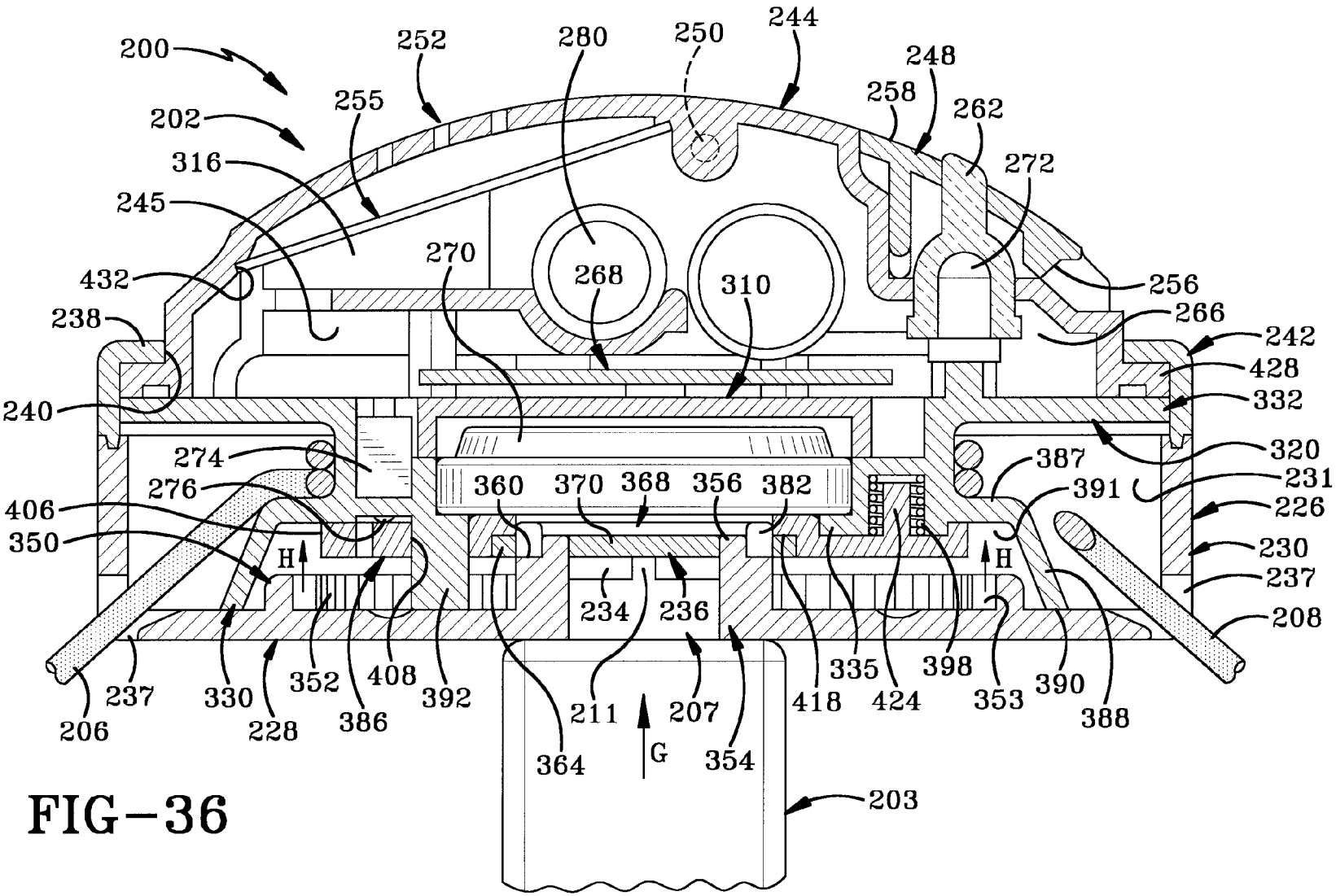
FIG. 36 is similar to FIG. 35 and shows the key end of the locking member moving the locking disk and gear disk to the unlocked position of the ratchet mechanism.

Gear disc 386 is a substantially flat and circular member having a body 400 and three resilient locking pawls 402 which are cantilevered from body 400 along an outer perimeter 404 thereof. Locking pawls 402 are equally circumferentially spaced from one another and include respectively a plurality of locking teeth 406 which extend radially outwardly. The resilient nature of locking pawls 402 allows them and teeth 406 to move radially inwardly and spring back radially outwardly. Body 400 defines three guide holes 408 for respectively slidably receiving therein guide bars 392 of spool 320 whereby gear disc 386 is axially slidable relative to spool 320 and is operationally connected to spool 320 and top wall portion 244 to rotate therewith. Body 400 further defines three clip holes 410 for slidably receiving retaining clips 394 with a snap fit connection therebetween to retain gear disc 386 on spool 320 (FIG. 32) against the downward spring force of springs 398 primarily for purposes of assembly. Body 400 is stepped upwardly from a lower surface 412 thereof to an elevated annular wall 414 via an axially extending annular step 416 which defines a circular recess 418. Annular wall 414 has a circular inner surface or perimeter 420 which defines a central hole 422. As shown in FIG. 36, recess 418 is configured to receive therein outer annular wall portion 364 of locking disc 236 with an outer perimeter of wall portion 364 closely adjacent or abutting axial step 416 and an upper surface of wall portion 364 abutting a lower surface of annular wall 414. Hole 422 receives noncontinuous annular wall 368 of locking disc 236 with an outer perimeter of wall 368 closely adjacent or abutting inner perimeter 420. Ratchet mechanism is free of fasteners which connect locking disc 236 and gear disc 386 to one another. Discs 236 and 386 abut one another via a frictional engagement such that locking disc 236 is able to rotate relative to gear disc 386 when in an unlocked position and gear disc 386 during rotation thereof is capable of causing locking disc 236 to rotate therewith, as detailed further below. Referring to FIG. 31, three spring-positioning projections 424 extend upwardly from body 400 of disc 236 and are insertable respectively into springs 398 (FIG. 35). A broken annular strengthening wall 426 also extends upwardly from body 400.

Referring to FIG. 33, top wall portion 244 further includes an outer annular wall 428 which extends radially outwardly from respective lower ends of half dome-shaped portion 246 and semi-circular portion 254. Annular wall 428 along an upper surface thereof slidably engages a lower surface of annular top wall 238 of top ring 242 of housing 226 (FIG. 35) during rotation of top wall portion 244 about axis C. A plurality of alignment tabs 430 project downwardly from annular wall 428 and are received in alignment holes 344 of upper flange 332 of spool 320 with annular wall 428 seated on upper flange 332 (FIG. 35) so that top wall portion 244 is operationally connected with spool 320 whereby rotation of top wall portion 244 will rotate spool 320 therewith. Annular wall 428 and flange 332 have outer perimeters which have substantially the same diameter and are disposed closely adjacent or in abutment with the inner surface of the ring 242 portion of sidewall 230 of housing 226. A circular recess 432 is formed on the inside surface of top wall portion 244 for mounting therein speaker 255. LED 272 is disposed in a cavity defined by light pipe 262.

Figure 34:
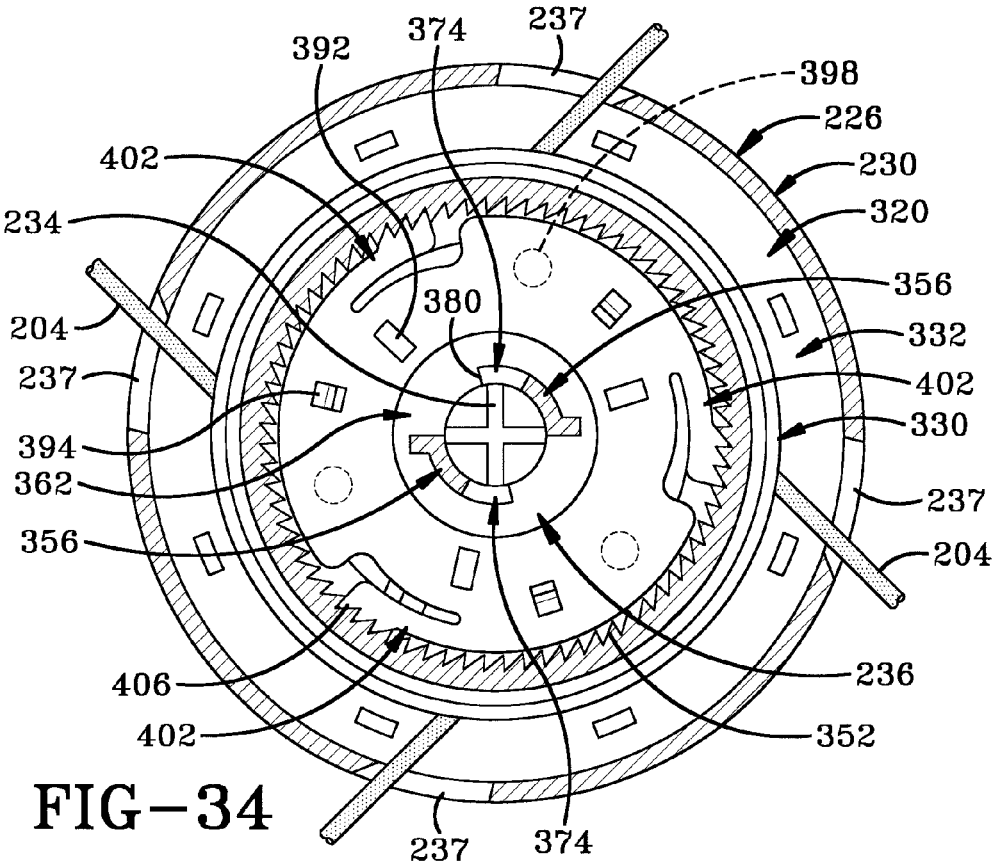
FIG. 34 is a sectional view taken on line 34-34 of FIG. 23 showing the locking disk and the gear disk in the locked position.

The basic operation of device 200 is substantially similar to that of device 1 with regard to installation on package 2 and removal therefrom except for the use of key end 207 and the movement of various elements of ratchet mechanism 202, which is now detailed with reference to FIGS. 34-47 without repeating aspects common to operation of device 1. FIGS. 34-35 show ratchet mechanism 202 in a locked position with locking teeth 406 of gear disc 386 lockably engaging locking teeth 352 of housing 226 to prevent rotation of spool 320 about axis C in a cable-loosening direction which would allow cable 204 to unwind from spool 320. Gear disc 386 is shown in its locked position with gear disc 386 abutting an upper surface of bottom wall 228 (FIG. 35). Locking disc 236 is in its locked position with arcuate retaining projections 356 and seating ledges 360 extending upwardly through respective arcuate and radial slot sections 376 and 382. In the locked position of disc 236, seating ledges 360 serve to prevent rotation of disc 236 due to the interference therebetween when ledges 360 are disposed in radial slot sections 382. Key end 207 of base 203 of locking member 205 is positioned in FIG. 35 just prior to unlocking mechanism 202.

FIG. 36 shows base 203 having moved axially upward in linear fashion as indicated at Arrow G to insert key end 207 into opening 232 to engage keying formation 234 and move locking disc 236 and gear disc 386 axially upward in a single linear direction (Arrows H) from the locked positions thereof (FIG. 35) to their respective unlocked positions. Gear disc 386 thus moves out of cavity 353 to disengage locking teeth 406 from locking teeth 352. Gear disc 386 compresses springs 398 and depresses plunger 276 as it moves to its unlocked position in which gear disc abuts respective lower surfaces of hub 328 and inner annular wall 387 of spool 320. Projections 356 remain within slot sections 376 in the unlocked position, thus ensuring that locking disc 236 never slips out of position. With locking teeth 406 and 352 disengaged from one another, spool 320 is in a free wheeling position in which it is able to rotate in the cable-loosening direction to unwind cable 204 therefrom. However, compressed springs 398 will force gear disc 386 back to its locked position if the upward force applied via base 203 is simply removed with no further action.

Figure 37:
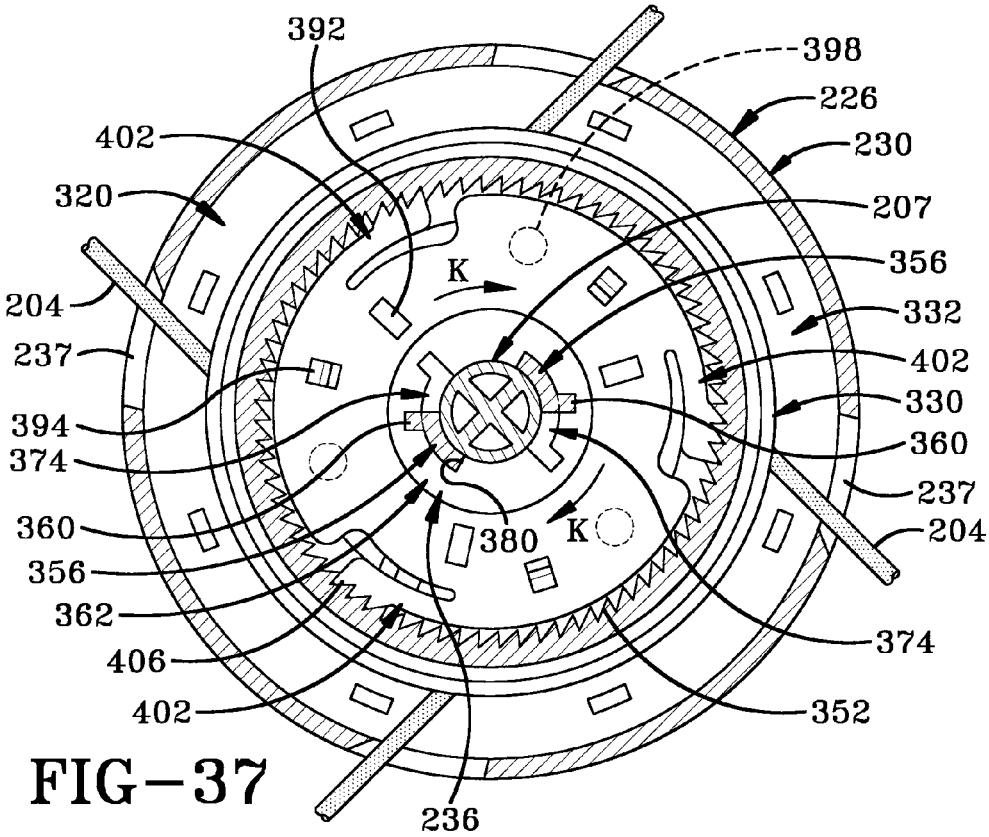
FIG. 37 is similar to FIG. 34 and shows the gear disk and locking disk in a raised unlocked position with the locking disk rotated to the retaining position to prevent the gear disk from returning to the locked position.
Figure 38:
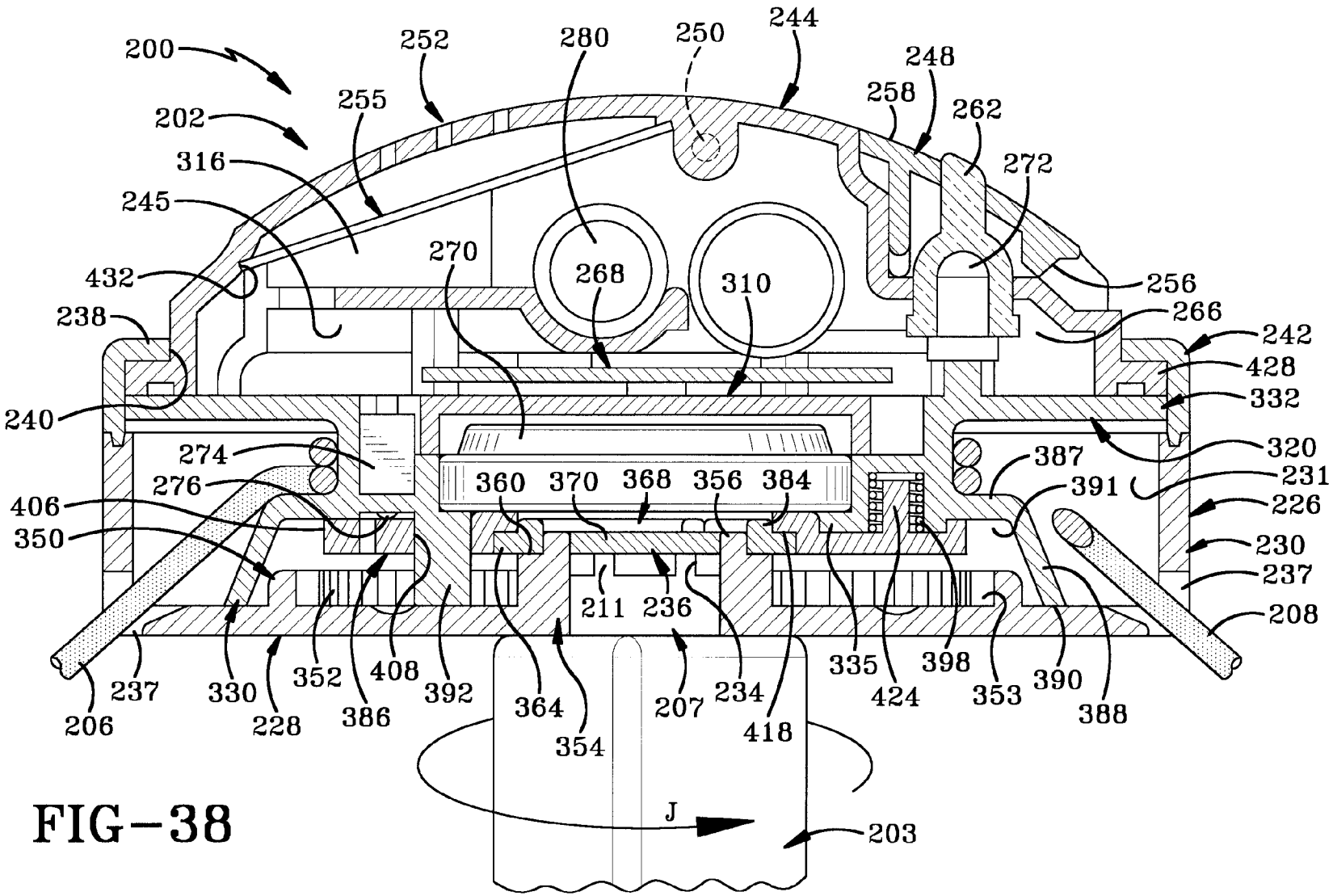
FIG. 38 is similar to FIG. 36 and shows the key rotated to rotate the locking disk to the retaining position.
Figure 39:
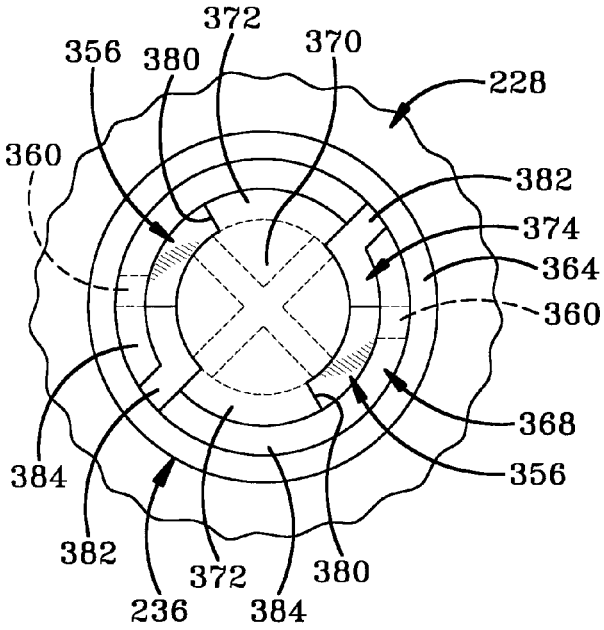
FIG. 39 is a fragmentary top view of the retaining mechanism with the locking disk in the retaining position.

Thus, as shown in FIGS. 37-38, base 203 is rotated (Arrow J in FIG. 38) to rotate locking disc 236 in the cable-loosening direction (Arrows K in FIG. 37) to a retaining position via engagement of key end 207 with keying formation 234. Locking disc 236 rotates relative to gear disc 386 in this process and thus outer annular wall portion 364 of disc 236 slidably engages elevated annular wall 414 of gear disc 386 during rotation of disc 236. In the unlocked position, this rotation is possible because seating ledges 360 are no longer disposed in radial slot sections 382 and disc 236 is able to rotate with arcuate projections 356 within arcuate slot sections 376. When thus rotated, respective portions of locking disc 236 are seated atop seating ledges 360 (FIGS. 38-39) to create an interference therebetween in the retaining position to prevent disc 236 from being forced back to its locked position. Key end 207 of base 203 may then be removed from opening 232 to disengage from locking disc 236 while locking disc 236 and gear disc 386 remain in their unlocked positions (FIG. 40) to allow the free wheeling rotation of gear disc 386 and spool 320 (Arrows L in FIG. 41) in the loosening direction to allow cable 204 to unwind from spool 320 and thus loosen (Arrows M in FIG. 41).

Figure 42:
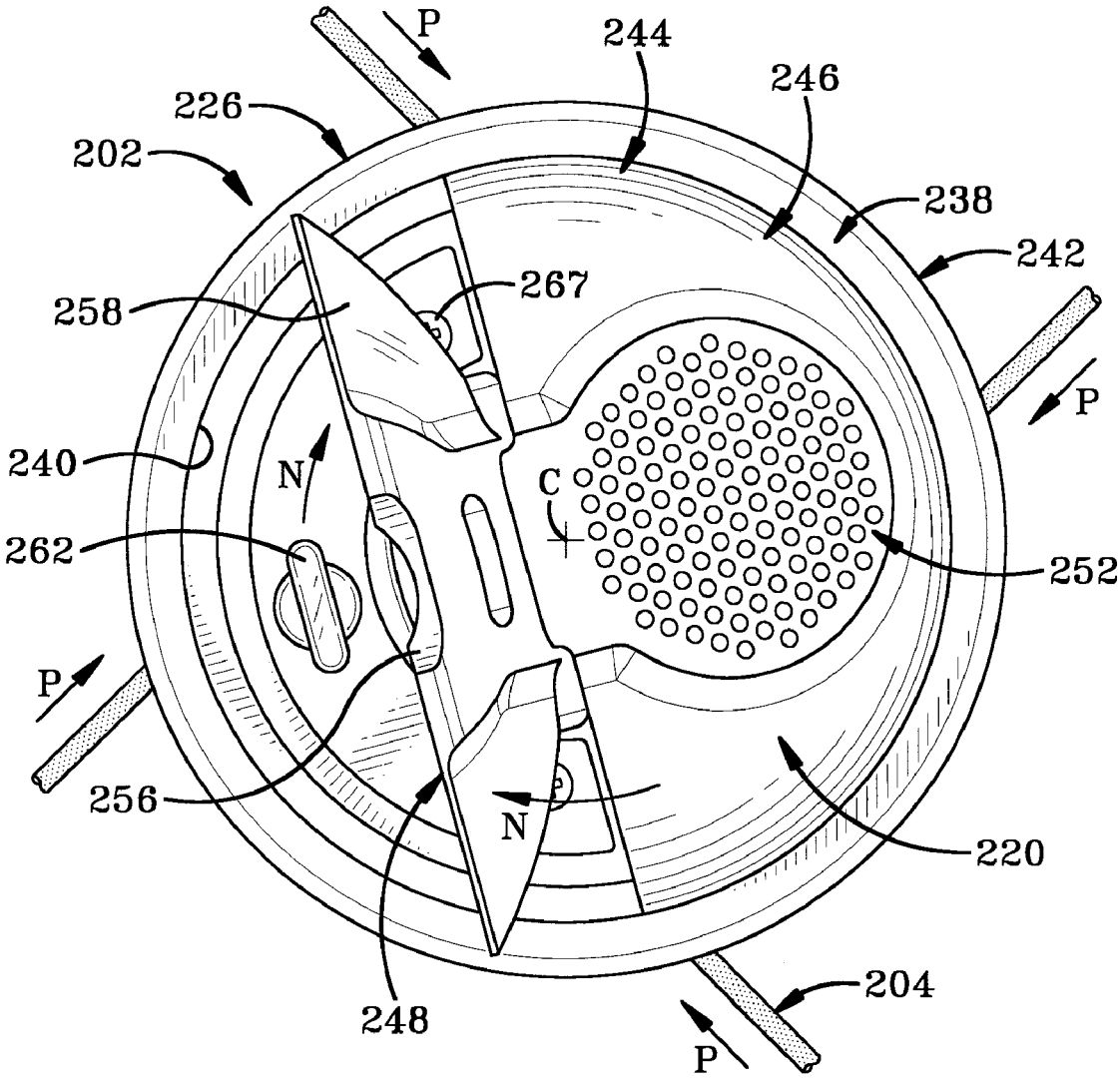
FIG. 42 is similar to FIG. 24 and shows the use of the flip-up handle to rotate the various rotatable members including the spool in order to tighten the cables.
Figure 43:
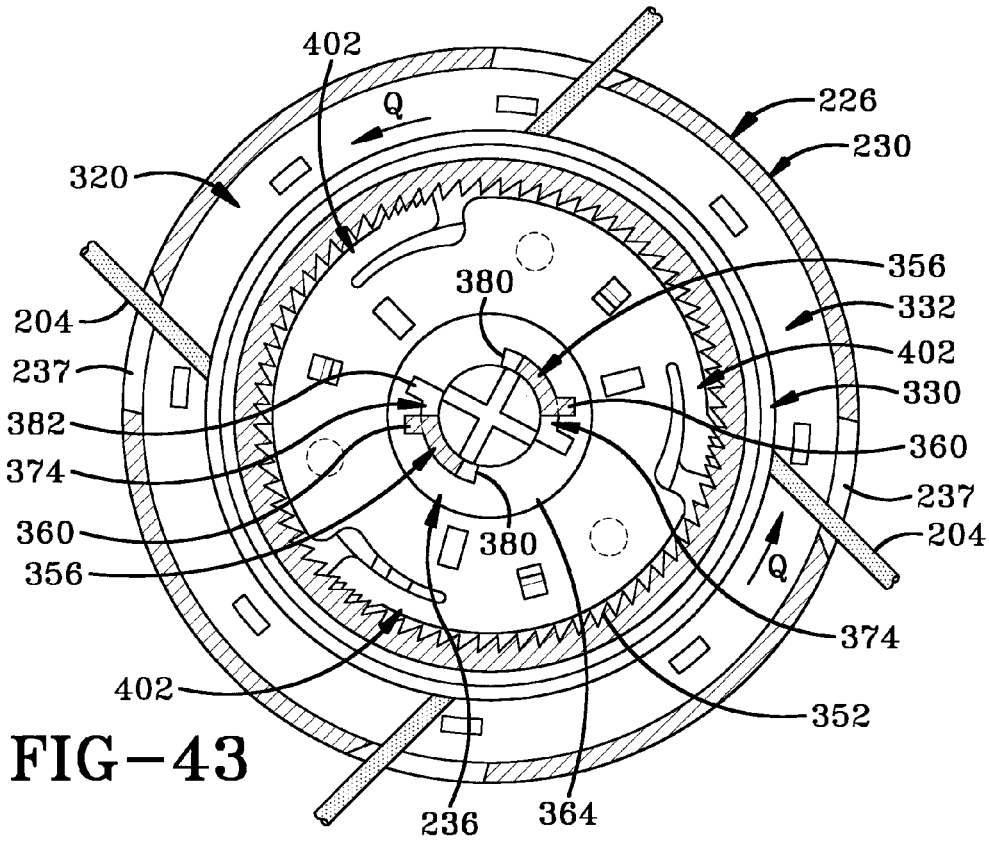
FIG. 43 is similar to FIG. 41 and shows the tightening rotation of the spool, gear disk and locking disk with the locking disk moving away from the retaining position.
Figure 44:
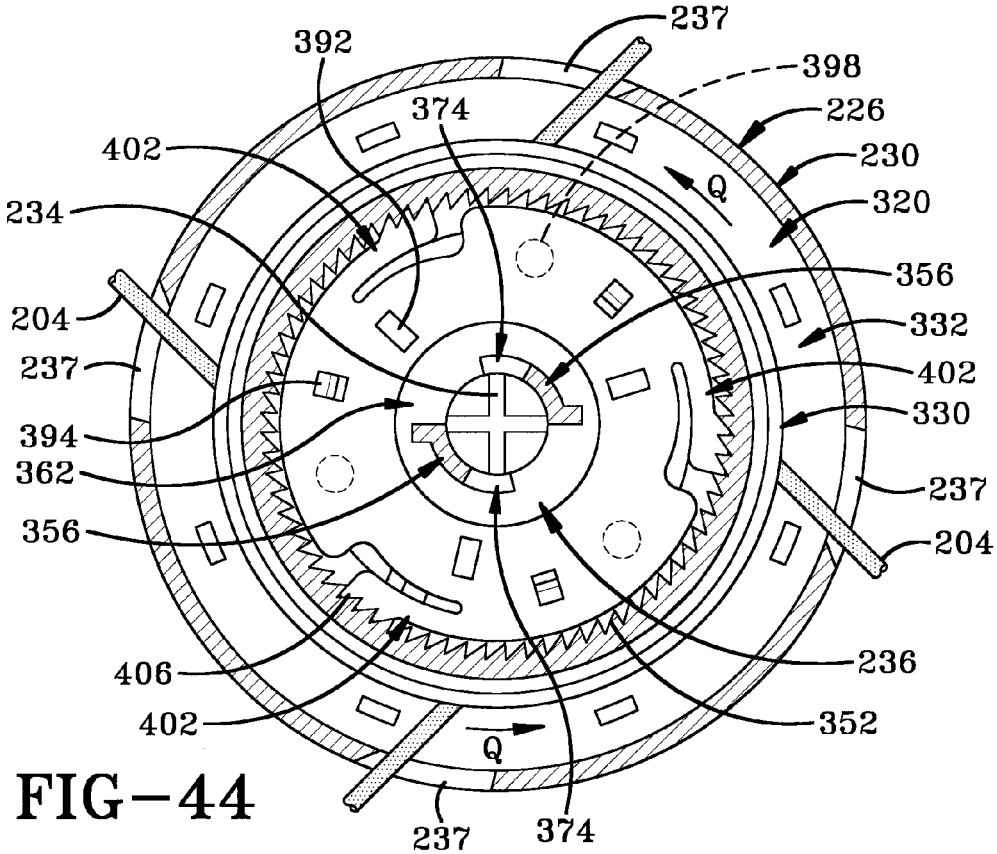
FIG. 44 is similar to FIG. 43 and shows the locking disk having rotated out of the retaining position to allow the locking disk and gear disk to move downwardly to the locked position.
Figure 45:
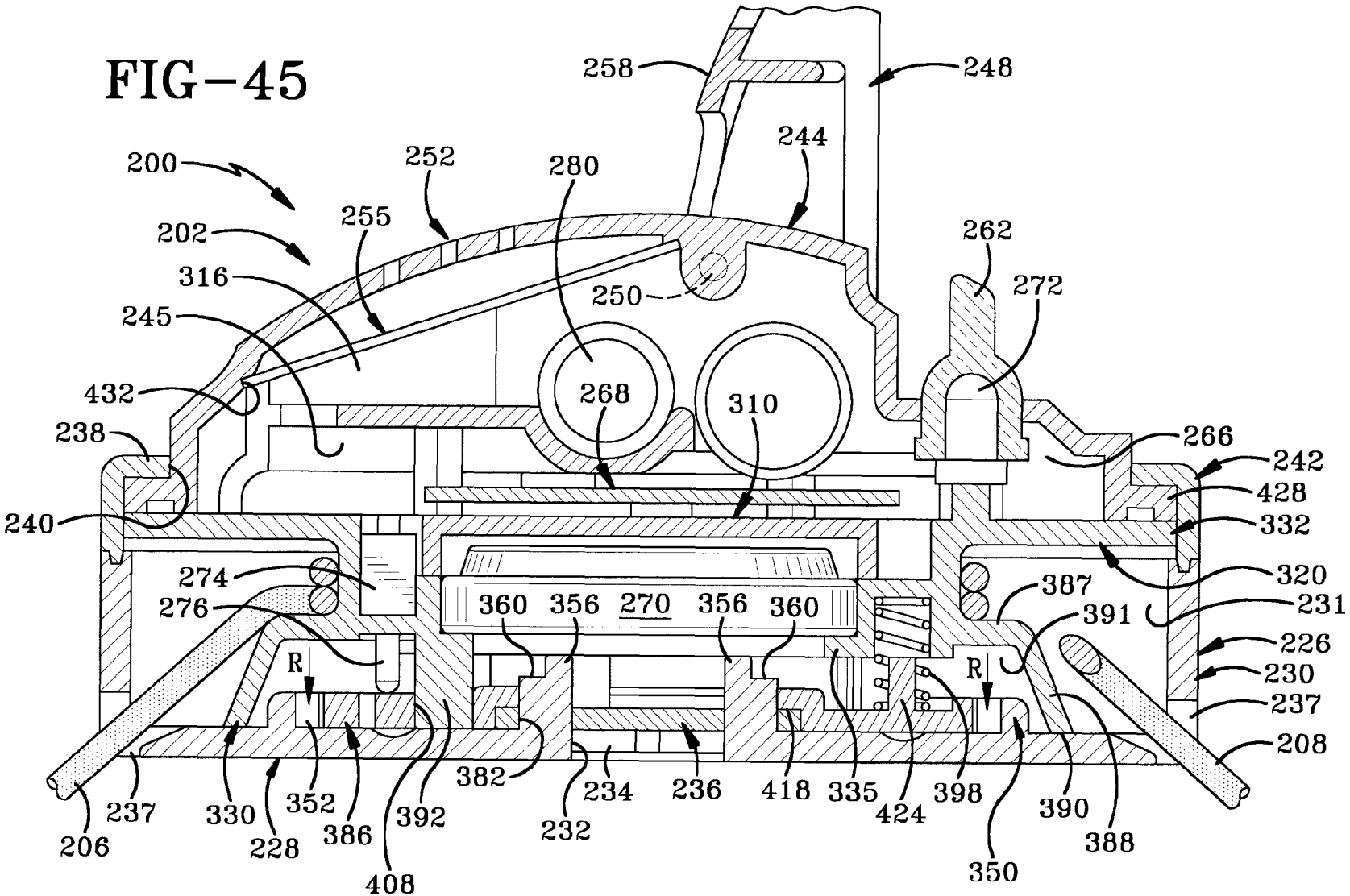
FIG. 45 is similar to FIG. 35 and shows the gear disk and locking disk moving downwardly to the locked position.

In order to tighten cable 204 again for use on another package like package 2, flip-up handle 248 is simply flipped up to the raised position (FIG. 42) and rotated in the cable-tightening direction (Arrows N in FIG. 42) which rotates spool 320 (Arrows Q in FIGS. 43-44) to wind cable 204 thereon to tighten cable 204 (Arrows P in FIG. 42). Rotation of spool 320 causes rotation of locking disc 236 in the cable-tightening direction via the frictional engagement therebetween (FIGS. 43-44). FIG. 43 shows locking disc 236 rotating away from the position shown in FIG. 41 while slidably riding on seating ledges 360 and continuing to retain gear disc 386 in the unlocked position. FIG. 44 shows locking disc 236 having rotated sufficiently to allow seating ledges 360 to align with radial slot sections 382 so that springs 398 force gear disc 386 and locking disc 236 linearly downwardly to their locked positions, as indicated at Arrows R in FIG. 45, with ledges 360 in slot sections 382 and with locking teeth 406 and 352 engaging one another allow rotation of spool 320 in the cable-tightening direction (FIG. 44) and prevent the opposite rotation.

Figure 46:
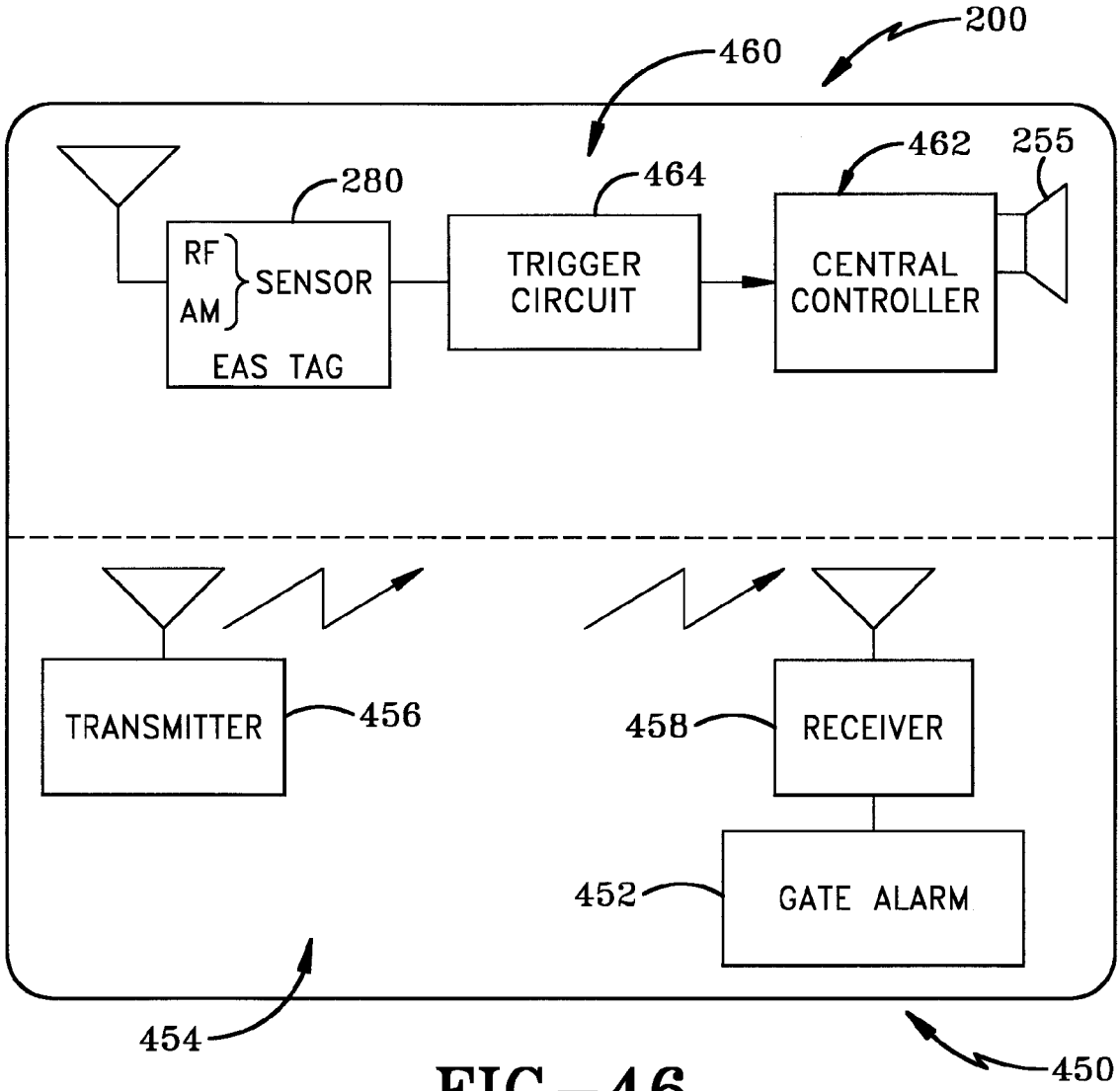
FIG. 46 is a block diagram of the security system of the present invention.

With reference to FIG. 46, security device 200 is part of a security system 450. Security system 450 includes a gate alarm 452 located in close proximity to a security gate 454. Security gate 454 includes a transmitter 456 and a receiver 458 for detecting an active EAS tag 280 upon it passing through security gate 454 by use of radio frequency (RF) or magnetic sensitivity (AM), all of which are well known in the security field, and thus are not described in further detail.

Device 200 is shown diagrammatically in the upper portion of FIG. 46 and includes a main circuit module 460 in the form of PCB 268 (FIG. 26), which includes a central controller 462, a trigger circuit 464 and EAS tag 280. Device 200 includes various sense loops for sounding an alarm if compromised.

When the integrity of the sense loop 282 (FIG. 26) is compromised, such as being cut, disconnected from the merchandise or pulled loose from the physical housing of the security device, it will cause central controller 462 to actuate audible alarm 255. Unless deactivated by store personnel, alarm 36 will continue to sound for a predetermined period of time, for example ten minutes thus increasing the difficulty of the thief concealing the merchandise even after leaving the store from which the merchandise was stolen. Central controller 462 sends pulses out periodically through sense loop 282 to ensure the sense loop is operating and that its integrity has not been compromised.

Sense loop 283 (FIG. 26) monitors an internal switch, such as reed switch 278, to determine if it has been actuated such as by use of a key to unlock or deactivate the protected display assembly or other protected device. Reed switch 278 can be either normally open or normally closed, to determine the condition thereof. For example, switch 278 (FIG. 2) can be actuated when a magnetic release key is placed on the security device to disarm the alarming circuit or to physically open and unlock the security device to remove it from the protected merchandise. Pressure switch 276 will actuate alarm 36 if unauthorized tampering depresses plunger 278 in response to unauthorized movement of locking disc 236 and gear disc 386 (FIG. 36). Controller 462 preferably provides a blinking on/off effect to LED 272 to advise store personnel that the security device is activated and to warn a potential thief that the merchandise is protected by an active security device which may help deter shoplifting.

Trigger circuit 464 works in conjunction with a security gate system external to security device 200 and in particular transmitter 456. The excitation level of trigger circuit 464 increases as EAS tag 280 approaches transmitter 456, and is adjusted by the selection and values of various resistors and capacitors therein to actuate alarm 255 when a specific level of excitation is reached. This correlates to a specific distance from security gate 454, and is usually closer than the authorized checkout counter and areas of a retail store. Thus, should a shoplifter attempt to steal package 2 with device 200 attached thereto without compromising the integrity of any of the sense loops, audible alarm 255 will still sound and remain audible for a specific period of time upon the shoplifter even approaching security gate 454 due to the RF or AM sensor 280 and trigger circuit 464 through central controller 462. Also as noted earlier, upon the shoplifted merchandise passing through security gate 454, EAS tag 250 will actuate the security gate alarm 452. This provides an additional security feature since at certain times, the security gate system may not be activated to sound its alarm due to the reduced sensitivity thereof but security device 200 would actuate internal alarm 255 that would remain audible on the stolen merchandise as it is removed from the premises, alerting personnel in the parking lot, adjacent streets, etc. that the item has been stolen since the alarm is still sounding.

In short, security system 450 provides for the sounding of an alarm should sense loops be compromised or device 200 be removed in an unauthorized manner from package 2; the sounding of a security gate alarm upon passing through the gate; and the sounding of the alarm contained in device 200 upon reaching a predetermined distance from the security gate, thus providing an alarm even though device 200 has not been removed from the protected merchandise.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A security device comprising:

a housing;

a first cable;

a spool within the housing which is rotatable about a vertical axis in a cable-tightening direction to wind the cable thereon and rotatable in an opposite cable-loosening direction to unwind the cable therefrom;

a first engaging member within the housing;

a second engaging member within the housing; wherein the first engaging member is rotatable with the spool relative to the housing and second engaging member about the vertical axis and is movable upwardly and downwardly relative to the spool and second engaging member between a locked position in which the first engaging member engages the second engaging member to prevent rotation of the spool in the cable-loosening direction and an unlocked position in which the first engaging member is disengaged from the second engaging member to allow rotation of the spool in the cable-loosening direction; and an automatic return which is initiated by rotation of the spool in the cable-tightening direction to automatically return the first engaging member from the unlocked position to the locked position.

2. The device of claim 1 further comprising a retaining member within the housing which is rotatable relative to the first engaging member and housing between a retaining position which prevents the first engaging member from moving from the unlocked position to the locked position and a non-retaining position which allows the first engaging member to move from the unlocked position to the locked position.

3. The device of claim 2 wherein the unlocked position is a raised position and the locked position is a lowered position.

4. The device of claim 3 further comprising a seating ledge within the housing on which the retaining member is seated in the retaining position and on which the retaining member is not seated in the non-retaining position.

5. The device of claim 4 further comprising a slot formed in the retaining member; and a projection which extends upwardly within the housing; and wherein the seating ledge is an upwardly facing surface of the projection; and wherein the retaining member is movable upwardly and downwardly with the projection received in the slot.

6. The device of claim 2 wherein the retaining member slidably engages the first engaging member during rotation relative to the first engaging member.

7. The device of claim 6 wherein the retaining member rotates in response to rotation of the spool via a frictional engagement between the retaining member and first engaging member.

8. The device of claim 2 wherein the retaining member is rotatable relative to the first engaging member about the vertical axis.

9. The device of claim 2 wherein the retaining member rotates in response to rotation of the spool in the cable-tightening direction.

10. The device of claim 2 wherein the retaining member is a disc.

11. The device of claim 2 further comprising a first annular surface on one of the first engaging member and retaining member; and a sliding engagement between the first annular surface and the other of the first engaging member and retaining member during relative rotation between the first engaging member and retaining member.

12. The device of claim 11 further comprising a second annular surface on the other of the first engaging member and retaining member; and wherein sliding engagement is between the first and second annular surfaces.

13. The device of claim 2 wherein one of the first engaging member and retaining member comprises an annular wall which has a circular inner perimeter defining a circular opening; and the other of the first engaging member and retaining member comprises a wall which has a circular outer perimeter and which is received in the circular opening with the circular inner and outer perimeters closely adjacent one another.

14. The device of claim 1 further comprising a spring which biases the first engaging member to the locked position; an unlocking mechanism which applies a force which moves the first engaging member to overcome the spring bias; and a retaining mechanism for retaining the first engaging member in the unlocked position when the force is removed.

15. The device of claim 1 further comprising a key member; an opening formed in the housing; and wherein the vertical axis passes through the opening; and insertion of the key member into the opening causes movement of the first engaging member from the locked position to the unlocked position.

16. A security device comprising:

a housing;

a first cable;

a spool within the housing which is rotatable about a vertical axis in a cable-tightening direction to wind the cable thereon and rotatable in an opposite cable-loosening direction to unwind the cable therefrom;

a first engaging member within the housing which is rotatable with the spool relative to the housing about the vertical axis and which is movable upwardly and downwardly relative to the spool between a locked position which prevents rotation of the spool in the cable-loosening direction and an unlocked position which allows rotation of the spool in the cable-loosening direction;

an automatic return which is initiated by rotation of the spool in the cable-tightening direction to automatically return the first engaging member from the unlocked position to the locked position;

a retaining member within the housing which is rotatable relative to the first engaging member and housing between a retaining position which prevents the first engaging member from moving from the unlocked position to the locked position and a non-retaining position which allows the first engaging member to move from the unlocked position to the locked position;

an arcuate slot which is formed in the retaining member and is concentric about the vertical axis; and a projection which extends upwardly within the housing; and wherein the retaining member is rotatable with the projection received in the arcuate slot.

17. A security device comprising:

a housing;

a first cable;

a spool within the housing which is rotatable about a vertical axis in a cable-tightening direction to wind the cable thereon and rotatable in an opposite cable-loosening direction to unwind the cable therefrom;

a first engaging member within the housing which is rotatable with the spool relative to the housing about the vertical axis and which is movable upwardly and downwardly relative to the spool between a locked position which prevents rotation of the spool in the cable-loosening direction and an unlocked position which allows rotation of the spool in the cable-loosening direction;

an automatic return which is initiated by rotation of the spool in the cable-tightening direction to automatically return the first engaging member from the unlocked position to the locked position; and a key member for moving the first engaging member from the locked position to the unlocked position; and wherein the key member is connected to the cable distal the housing.

18. A security device comprising:

a housing;

a first cable;

a spool within the housing which is rotatable about a vertical axis in a cable-tightening direction to wind the cable thereon and rotatable in an opposite cable-loosening direction to unwind the cable therefrom;

a first engaging member within the housing which is rotatable with the spool relative to the housing about the vertical axis and which is movable upwardly and downwardly relative to the spool between a locked position which prevents rotation of the spool in the cable-loosening direction and an unlocked position which allows rotation of the spool in the cable-loosening direction;

an automatic return which is initiated by rotation of the spool in the cable-tightening direction to automatically return the first engaging member from the unlocked position to the locked position;

a second cable windingly received on the spool; and a locking member comprising first and second components respectively connected to the first and second cables distal the housing and lockably engageable with one another to lock the two cables to one another.

19. A security device comprising:

a housing;

a first cable;

a spool within the housing which is rotatable about a vertical axis in a cable-tightening direction to wind the cable thereon and rotatable in an opposite cable-loosening direction to unwind the cable therefrom;

a first engaging member within the housing which is rotatable with the spool relative to the housing about the vertical axis and which is movable upwardly and downwardly relative to the spool between a locked position which prevents rotation of the spool in the cable-loosening direction and an unlocked position which allows rotation of the spool in the cable-loosening direction;

an automatic return which is initiated by rotation of the spool in the cable-tightening direction to automatically return the first engaging member from the unlocked position to the locked position; and a second engaging member; and wherein the first engaging member comprises a body and a plurality of locking pawls which are mounted on the body and movable relative to the body radially inwardly toward the axis and radially outwardly away from the axis; wherein the locking pawls releasably engage the second engaging member to provide the locked position.

20. A security device comprising:

a housing;

a first cable;

a spool within the housing which is rotatable about a vertical axis in a cable-tightening direction to wind the cable thereon and rotatable in an opposite cable-loosening direction to unwind the cable therefrom;

a first engaging member within the housing which is rotatable with the spool relative to the housing about the vertical axis and which is movable upwardly and downwardly relative to the spool between a locked position which prevents rotation of the spool in the cable-loosening direction and an unlocked position which allows rotation of the spool in the cable-loosening direction; and a retaining member within the housing which is rotatable relative to the first engaging member between a retaining position which prevents the first engaging member from moving from the unlocked position to the locked position and a non-retaining position which allows the first engaging member to move from the unlocked position to the locked position.

21. The device of claim 20 further comprising a recess formed in the first engaging member; and wherein the retaining member is within the recess in the locked and unlocked positions.

22. The device of claim 20 wherein the retaining member engages the first engaging member.

23. The device of claim 22 wherein the retaining member slidably engages the first engaging member during rotation of the retaining member relative to the first engaging member from the non-retaining position to the retaining position.

24. The device of claim 23 further comprising a frictional engagement between the retaining member and first engaging member; and wherein rotation of the first engaging member causes rotation of the retaining member via the frictional engagement from the retaining position to the non-retaining position.

25. The device of claim 20 further comprising a spring within the housing which biases the first engaging member downwardly relative to the spool.

26. The device of claim 25 further comprising a first end of the spring which engages the spool and a second opposed end of the spring which engages the first engaging member.

27. The device of claim 25 wherein the spring biases the retaining member downwardly relative to the spool.

28. The device of claim 20 wherein the retaining member is a rigid disc having an outer perimeter which is concentric about the axis.

29. The device of claim 20 further comprising an entrance opening formed in the housing; and a key member which is insertable through the entrance opening into contact with the retaining member.

30. The device of claim 29 wherein rotation of the key member while in contact with the retaining member causes the retaining member to rotate relative to the housing, spool and first engaging member.

31. The device of claim 20 wherein the housing comprises top and bottom walls; the spool comprises a hub, and upper and lower flanges secured to the hub and extending radially outwardly away from the axis such that the cable winds around the hub between the upper and lower flanges; and the retaining member and first engaging member are between the lower flange and bottom wall of the housing.

32. The device of claim 20 further comprising a key member for moving the first engaging member from the locked position to the unlocked position; and wherein the key member is connected to the cable distal the housing.

33. The device of claim 20 further comprising a second cable windingly received on the spool; a locking member comprising first and second components respectively connected to the first and second cables distal the housing and lockably engageable with one another to lock the two cables to one another.

34. The device of claim 20 further comprising a second engaging member; and wherein the first engaging member comprises a body and a plurality of locking pawls which are mounted on the body and movable relative to the body radially inwardly toward the axis and radially outwardly away from the axis; wherein the locking pawls releasably engage the second engaging member to provide the locked position.

* * * * *